US007108964B2

(12) United States Patent
Singer et al.

(10) Patent No.: US 7,108,964 B2
(45) Date of Patent: Sep. 19, 2006

(54) COMPOUND CONTAINING AN ANTHRANILIC ACID BLOCKING GROUP

(75) Inventors: Stephen P. Singer, Spencerport, NY (US); Philip A. Allway, Croxley Green (GB); Trevor J. Wear, Harrow (GB); Louis E. Friedrich, Rochester, NY (US); Siu (Lambert) C. Tsoi, Watford (GB); Bernard A. Clark, Maidenhead (GB); Paul L. Stanley, Harrow (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/198,758

(22) Filed: Aug. 5, 2005

(65) Prior Publication Data

US 2006/0051710 A1 Mar. 9, 2006

Related U.S. Application Data

(63) Continuation of application No. 10/937,077, filed on Sep. 9, 2004, now abandoned.

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/505; 430/955; 430/956; 430/957; 430/958; 430/959; 430/960; 430/544

(58) Field of Classification Search ..... 430/955–960, 430/505, 544

See application file for complete search history.

(56) References Cited

U.S. PATENT DOCUMENTS

| | | | |
|---|---|---|---|
| 4,248,962 | A | 2/1981 | Lau |
| 4,409,323 | A | 10/1983 | Sato et al. |
| 4,421,845 | A | 12/1983 | Uemura et al. |
| 4,477,563 | A | 10/1984 | Ichijima et al. |
| 4,847,185 | A | 7/1989 | Begley et al. |
| 4,857,440 | A | 8/1989 | Begley et al. |
| 4,859,578 | A | 8/1989 | Michno et al. |
| 4,933,989 | A | 6/1990 | Kume et al. |
| 5,326,680 | A | 7/1994 | Ohkawa et al. |
| 5,576,167 | A | 11/1996 | Poslusny et al. |
| 5,827,637 | A | 10/1998 | Uchida et al. |
| 5,827,638 | A | 10/1998 | Tsukahara et al. |

*Primary Examiner*—Geraldine Letscher
(74) *Attorney, Agent, or Firm*—Sarah Meeks Roberts

(57) ABSTRACT

The invention relates to a novel kind of anthranilic acid compound that releases a UG as a function of chemical bond cleavage according to Formula (I):

Q-(AAS)-UG where UG is an useful group and is chemically bonded to (AAS); (AAS) is an anthranilic acid switching group; and Q is a group in which the bond to (AAS) is broken so that the -(AAS)-UG fragment subsequently decomposes to the free UG.

In one embodiment this invention relates to a multilayer silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one layer additionally contains an anthranilic acid compound according to Formula (II):

G-$(TG1)_q$-(AATG)-$(TG2)_p$-PUG where G is a group in which the bond to the timing group is cleaved upon reaction with oxidized developer; TG1 and TG2 represent any known timing or switching group and may be the same or different; q and p are independently 0 or 1; AATG represents an anthranilic acid timing group and PUG is a photographically useful group.

21 Claims, No Drawings

COMPOUND CONTAINING AN ANTHRANILIC ACID BLOCKING GROUP

CROSS-REFERENCE TO RELATED APPLICATIONS

This is a Continuation of U.S. Ser. No. 10/937,077 filed Sep. 9, 2004 now abandoned.

FIELD OF THE INVENTION

This invention relates to the release of useful chemical groups in response to a chemical bond cleavage reaction by the fragmentation of a new type of blocking or timing group based on analogs of anthranilic acid. In one embodiment, this invention relates to a conventional silver halide photographic material containing at least one light sensitive silver halide emulsion and a compound that upon reaction with oxidized developer, releases a PUG (photographically useful group) via a new type of timing group based on analogs of anthranilic acid.

BACKGROUND OF THE INVENTION

In many processes, such as in a chemical process, it is desirable to have a specific chemical moiety, group or fragment available so that it can provide a beneficial and useful effect. These are called useful groups (UG). However, in some cases, the useful group cannot be directly present in the system or process but must be incorporated as a precursor group in a precursor compound. In such a compound the active part (useful group) that causes the useful effect is chemically blocked or is otherwise unavailable and then is converted or de-blocked into its active form at some point after the process has begun. Often, it is desirable that this conversion or de-blocking occurs as a function of cleavage of a specific chemical bond within the precursor compound. In such cases, there is an unstable intermediate group (sometimes referred to as a blocking group) that chemically connects the UG to that part of the molecule where the bond is broken during the process. After the bond is broken, the intermediate subsequently decomposes to release the UG.

For example, processes are known where reducing bacteria are added to a redox carrier that contains a blocked and shifted dye. The bacteria reduce the redox carrier to a form where the dye is released and provides optical density in a region different from its blocked form. Thus, an increase in optical density is a measure of the number or strength of reducing bacteria. In this example, the UG is the released dye and the redox carrier serves as a kind of chemical switch that causes the conversion of the inactive UG (the blocked dye) into its useful form as a function of a broken chemical bond (due to the bacteria). There are many different kinds of blocking groups that are known to release UGs under specific conditions or process.

As a particular example, it is well known in the photographic art to use compounds that upon reaction with oxidized developer (Dox) release various types of photographically useful groups (PUGs) in an imagewise fashion. There are many known ways to accomplish the release of a PUG upon reaction with Dox.

For example, the PUG can be chemically attached directly to the site of reaction with Dox such that the bond connecting the PUG to the rest of the compound is broken and the free PUG fragment released. Alternatively, the PUG can be attached to the rest of the compound indirectly through the use of an unstable intermediate group. Upon reaction with Dox, the unstable intermediate group still bearing the PUG is released and the free PUG fragment is then produced only after a subsequent decomposition step. It should be noted that reaction with Dox to release a PUG could be either via coupling (in which the oxidized developer becomes chemically bound to part of the compound) or via a redox reaction (in which the oxidized developer is reduced and the compound oxidized).

In the photographic art, these unstable intermediate groups that connect a PUG to a site of reaction with Dox are commonly referred to as timing or switching groups. These unstable groups have also been occasionally described as linking groups, but the term "linking group" is more correctly applied to intermediate groups that are stable and remain part of the PUG after reaction with Dox.

The function of these timing groups is widely varied and depends heavily on the requirements of the photographic use, the nature of the PUG and concerns over other issues such as rate of reaction with Dox, long-term keeping and synthesis. For example, it is often desirable for the timing group to decompose slowly on the development timescale so the -(timing group)-PUG complex can diffuse away from the site of reaction with Dox and thus release PUG in a remote location. In other uses, it is desirable for the timing group to decompose quickly such that the PUG is released almost instantaneously. In a similar manner, it may be desirable to increase the water solubility of a timing group in order to maximize diffusion in some uses, but decrease the water solubility and increase the molecular weight by adding an oil soluble ballasting group in order to restrict diffusion for other uses.

When the PUG is a fragment that inhibits silver development, compounds that release the inhibitor directly upon reaction with Dox are commonly referred to as DIRs (development inhibitor releasers). Compounds with an unstable timing group between an inhibitor fragment and the Dox reaction site are generally referred to as DIARs (development inhibitor assisted releasers).

Many different types of timing groups are known. For example, compounds that release a PUG via an intramolecular nucleophilic displacement have been described in U.S. Pat. No. 4,248,962, U.S. Pat. No. 4,857,440 and U.S. Pat. No. 4,847,185. Compounds that release a PUG via an electron transfer along a conjugated system have been described in U.S. Pat. No. 4,409,323, U.S. Pat. No. 4,859,578, U.S. Pat. No. 5,576,167, U.S. Pat. No. 4,421,845, U.S. Pat. No. 4,477,563 and U.S. Pat. No. 5,326,680. U.S. Pat. No. 4,933,989 describes a timing group that undergoes an intermediate redox reaction to release a PUG.

Despite a large number of attempts to provide UG releasing compounds with desirable performance, there still remains a need for materials with improved properties. In a particular embodiment, the problem remains to provide a silver halide photographic element having the desired tone scale with improved image structure and excellent color reproduction.

SUMMARY OF THE INVENTION

This invention provides a novel kind of anthranilic acid compound that releases a UG as a function of chemical bond cleavage according to Formula (I):

Q-(AAS)-UG where UG is an useful group and is chemically bonded to (AAS); (AAS) is an anthranilic acid switching group; and Q is a group bonded to (AAS) in which the bond to (AAS) is broken during some process so that the -(AAS)-UG fragment is released and undergoes an internal reaction to release the free UG. This invention further provides a silver halide photographic element comprising a support, at least one light-sensitive silver halide emulsion layer, and an anthranilic acid compound according to Formula (II):

$$G\text{-}(TG1)_q\text{-}(AATG)\text{-}(TG2)_p\text{-}PUG$$

where G is a group in which the bond to the timing group is cleaved upon reaction with oxidized developer; TG1 and TG2 represent any known timing or switching group and may be the same or different; q and p are independently 0 or 1; AATG represents an anthranilic acid timing group and PUG is a photographically useful group.

In one embodiment the silver halide element is a multilayer silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one layer additionally contains an anthranilic acid compound according to Formula (II).

In this usage, it has been found that anthranilic acid compounds can be used to release PUGs in an imagewise fashion and can provide a photographic element with excellent image structure and color reproduction. The compounds of the invention are very stable and are easy to synthesize. They also provide excellent control of the rate of release of the useful group and of fragment diffusion rates

DETAILED DESCRIPTION OF THE INVENTION

The invention is generally as described above. By "process", it is meant any treatment, including chemical, thermal, electrical or mechanical, that is used to cause changes in a starting compound or element and produce a desired effect. Process includes any method which causes one of the bonds in the anthranilic acid switch to cleave/break, thus (eventually) releasing the UG. The starting compound or element may be in solution or solid form. The process may occur in a single step or may involve a series of consecutive steps. Generally, the process converts the starting compound or element from its initial state to its final state. In the embodiment that relates to photographic elements, "process" refers to any of the known methods used to produce photographic images.

For the most general case of the compound of Formula (I), Q can be any group where the chemical bond to (AAS) is specifically broken or cleaved as a function of some part of a process or treatment. Cleavage of the bond between Q and (AAS) subsequently causes the breakage of the bond between (AAS) and UG thereby freeing the UG fragment in its active form. As one example, Q can be hydrogen attached to the carboxylic acid of an anthranilic acid derivative. During a high pH process, the hydrogen is removed to give a carboxylic acid anion and the remaining ionized AAS fragment subsequently decomposes to release the UG. It may also be possible to optionally include other unstable or intermediary groups or links between the Q and (AAS) groups so that the free (AAS) group is not released immediately. In a similar manner, the same type of unstable or intermediary groups may be present between (AAS) and the UG groups so that the UG is not released immediately. For the purposes of the invention, it is only important that the bonds between Q and (AAS) and between (AAS) and UG are eventually cleaved to release UG as a function of bond cleavage at Q. In this regard, any additional unstable or intermediate groups should be considered part of the (AAS) group.

The UG can be any chemical fragment or group that provides a beneficial or useful effect in the process or treatment after it is released from the (AAS) group. The UG is commonly inert and does not provide its benefit while still attached to (AAS). Some suitable examples of useful groups would have medicinal properties for either human or animals such as antibiotics, anti-cancer compounds, pyschoactives, sedatives, etc or materials useful for regulating bodily processes such as blood pressure, vision or clotting and the like. Other suitable examples of useful groups are those that are readily measured such as dyes or dye precursors so that the amount released is related to the amount of bond cleavage. Still more examples are those that can promote or inhibit growth of living organisms such as dietary supplements, herbicides, antifungal agents and the like.

(AAS) represents a switching group derived from anthranilic acid or a structural analog thereof. In this application, the term "anthranilic acid", in its most general sense, refers to any derivative of an aromatic ring bearing an amino group in an ortho position to a carboxy group. This aromatic ring can be derived from all carbon aromatic rings (such as phenyl, naphthyl, etc) or be an aromatic heterocyclic ring. This includes derivatives of 2-aminobenzoic acid (whose common name is anthranilic acid) which are most preferred.

Typically, the color silver halide photographic element useful in one aspect of the present invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. In another embodiment, it is also possible that the separate color forming layers are collapsed into one or more layers so that the element produces only neutral images. Any such imaging elements may be processed via thermal means only or can be processed using phenylenediamine based developers. It is preferred that the color silver halide elements are negative working silver halide elements. It is also preferred that the silver halide photographic elements are capture or origination elements such as a color negative film or a motion picture origination film.

The anthranilic acid group is attached between the moiety that reacts with oxidized developer and the UG. Its purpose is to act as a timing group; namely, be released initially as a -(anthranilic acid)-UG unit which subsequently decomposes to release a free -UG fragment. Depending on the nature of the UG and the structure and substituents of the anthranilic acid timing group, this decomposition to release the UG may be fast (less than 1 s) or slow (more than 1 s). The anthranilic acid timing group may also be solubilized or ballasted in order to achieve the desired balance of diffusion or lipophicity. It is believed the decomposition of the anthranilic acid timing group occurs via an intramolecular nucleophilic displacement as shown below for one type:

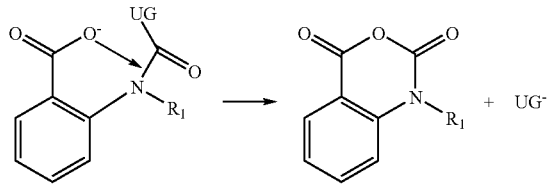

When used in a photographic element at least one layer contains an anthranilic acid compound according to Formula (II):

$$G\text{-}(TG1)_q\text{-}(AATG)\text{-}(TG2)_p\text{-}PUG$$

where G is a group in which the bond to the timing group is cleaved upon reaction with oxidized developer; TG1 and TG2 represent any known timing or switching group and may be the same or different; q and p are independently 0 or 1; AATG represents an anthranilic acid timing group and PUG is a photographically useful group. In one embodiment q and p are both 0. In another embodiment PUG is either an inhibitor of silver development or an electron transfer agent.

The preferred compound is represented by either Formula (IIa) or (IIb):

Formula (IIa)

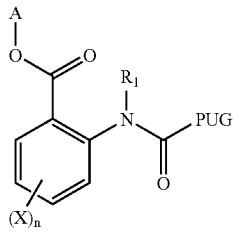

Formula (IIb)

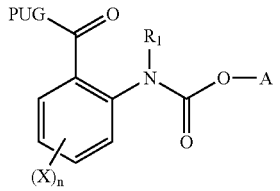

wherein:

A is a group in which the bond to oxygen is cleaved upon reaction with oxidized developer;

X is an optional substituent;

n is 0 to 4;

$R_1$ is an alkyl, aryl or heterocyclic group with the proviso that $R_1$ may be connected with X or the phenyl ring to form an additional ring system; and PUG is a photographically useful group.

Of these two formulas, Formula (IIa) is preferred.

G in the compound of Formula (II) or A in the compounds of Formulas (IIa) or (IIb) can be any known moiety that reacts with oxidized developer to break at least one of the chemical bonds that attach the anthranilic acid group. This generally includes moieties that react with Dox via a coupling reaction. Such a moiety may be known as a coupler moiety. Preferably A or G is a moiety that reacts with oxidized developer by a coupling reaction to form a stable or unstable dye. Examples of this type would include any class of materials that form a colored dye (i.e. yellow, magenta or cyan) as well as those that form dyes that are not stable to the process conditions or dyes that wash-out or are otherwise removed from the film. Preferred types of permanent dye forming coupler moieties are phenol and naphthol cyan dye-forming couplers, pyrazolone and pyrazolotriazole magenta dye-forming couplers and acetoanilide (including aryl, acyl and hetero substituted acetoanilide derivatives) based yellow dye-forming couplers. Preferred types of non-permanent dye forming couplers are those based on naphthols or acetoanilides. Such non-permanent dye forming couplers generally form dyes that do not contain ballast groups that limit diffusion and/or contain water solublizing groups. Also included are moieties that react with Dox via a redox reaction such as those described in U.S. Pat. No. 4,684,604 and JP Kokai 01244450A2. Particularly preferred are those based on naphthol couplers.

$R_1$ is an alkyl, aryl or heterocyclic group. When $R_1$ is an alkyl group, it should contain 1–30 carbon atoms, and more preferably 1 to 6 carbon atoms, it may be straight-chained or branched and may contain other substituents such as ether, thioether, ester, carbamoyl, sulfamoyl groups or water-solublizing groups such as carboxy or hydroxy. Examples of suitable alkyl groups include methyl, ethyl, isopropyl, 2-ethylhexyl, dodecyl or octadecyl. When $R_1$ is an aryl group, it should contain 6–30 carbon atoms, and more preferably 6 to 12 carbon atoms, and may be optionally substituted with groups like alkyl, halo, alkyloxy, sulfamoyl, sulfonamido, carboxy and the like. Examples of suitable aryl groups are phenyl, p-chlorophenyl, o-methoxyphenyl, p-methylphenyl, m-carboxyphenyl or m-methylsulfonamidophenyl. When $R_1$ is a heterocycle, it should contain 1–30 carbon atoms and may be optionally substituted with groups like alkyl, halo, alkyloxy, sulfamoyl, sulfonamido, carboxy and the like. Examples of suitable heterocycles include 3-pyridine and 2-thiadiazoles that are further substituted in the 5 position. Of these, it is most preferred that $R_1$ is an alkyl group.

X is a substituent. Substituent means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl; alkenyl; aryl; aryloxy; carbonamido; sulfonamido; sulfamoyl; carbamoyl; acyl; sulfonyl; sulfonyloxy; sulfinyl; thio; acyloxy; amine; imino; phosphate; phosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur; quaternary ammonium; and silyloxy. If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Two X substituents together can also form annulated ring systems; for example, timing groups based on 2-amino-1-carboxynaphthalene are contemplated. $R_1$ and X may optionally be joined together to form a ring system or $R_1$ may be attached directly to the aromatic ring of the anthranilic ring to form a bicyclic ring system. Generally, the above groups and substituents thereof may include those having up to 48 carbon atoms, typically 1 to 36 carbon atoms and usually less than 24 carbon atoms, but greater numbers are possible depending on the particular substituents selected. Preferably n is 0.

Photographically useful groups are those fragments that provide (after release from the anthranilic acid timing group) a desirable and beneficial photographic effect. Some suitable examples are inhibitors of silver development, development accelerators, foggants, anti-foggants, bleach accelerators, bleach inhibitors, fix accelerators, electron transfer agents (also referred to as ETAs), nucleators, scavengers of oxidized developers, couplers or coupler precursors, and dyes or dye precursors.

When the PUG is an inhibitor of silver development, it can be chosen from any known class of inhibitors of silver development. These are generally heterocyclic compounds and include among others; triazoles, oxadiazoles, thiadiazoles, oxathiazoles, benzotriazoles, tetrazoles, mercaptotetrazoles, selenotetrazoles, mercaptothiadiazoles, mercaptotriazoles, mercaptooxadiazoles, telleurotetrazoles, benzisodiazoles, thioureas, purines and other tetraazaindenes. Of these, preferred inhibitors are those that are based on nitrogen heterocycles that do not contain a thiol group. This includes benzotriazoles, triazoles, oxadiazoles, thiadiazoles and tetrazoles. Particularly useful are benzotriazoles. In addition, deactivating or self-destructing inhibitors that bear a hydrolyzable group such as those described in U.S. Pat. No. 4,782,012; U.S. Pat. No. 5,200,306 and DE3209486A1, said descriptions incorporated herein by reference, are also highly desirable. Typically, the hydrolyzable group in such self-destructing inhibitors are ester groups that react with some component of the developer solution such as hydroxy ion or hydroxylamine to form the corresponding carboxylic acid substituted inhibitor that is much less effective at development inhibition. Particularly suitable are those compounds where the self-destructing inhibitor fragment is a benzotriazole.

When PUG is an ETA (electron transfer agent), it can be chosen from any known class. The term "electron transfer agent" or ETA is employed in its art recognized sense of denoting a silver halide developing agent that donates an electron (becomes oxidized) in reducing $Ag^+$ in silver halide to silver $Ag^\circ$ and is then regenerated to its original non-oxidized state, preferably by entering into a redox reaction with primary amine color developing agent. Particularly useful are those based on 1-aryl-3-pyrazolidinone derivatives as for example, described in U.S. Pat. Nos. 4,209,580; 4,463,081; 4,471,045; and 4,481,287 and in published Japanese Patent Application Serial No. 62-123172, all incorporated herein by reference. Such compounds comprise a 3-pyrazolidinone structure having an unsubstituted or a substituted aryl group in the 1-position. Preferably these compounds have one or more alkyl groups in the 4- or 5-positions of the pyrazolidinone ring.

Preferably ETA is a 1-aryl-3-pyrazolidinone derivative having a calculated log partition coefficient (c log P) greater than or equal to 2.40 using MedChem v3.54 (Medicinal Chemistry Project, Pomona College, Claremont, Calif., 1987). It is also preferred that the c log P of the ETA fragment be no more than 5.0, or more preferably, no more than 4.0 or most preferably, 3.40 or less. Preferred electron transfer agents suitable for use in this invention are represented by structural formulas IIIa and IIIb:

Formula (IIIa)

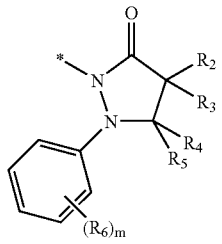

-continued

Formula (IIIb)

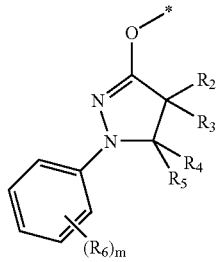

*denotes point of attachment to the anthranilic acid timing group;

$R_2$ and $R_3$ each independently represents hydrogen, a substituted or unsubstituted alkyl group having from 1 to 12 carbon atoms, $CH_2OR_7$ or $CH_2OC(O)R_7$ where $R_7$ can be a substituted or unsubstituted alkyl, aryl or a heteroatom containing group, $CH_2SR_7$, or $CH_2N(R_{7a})(R_{7b})$ wherein $R_{7a}$ or $R_{7b}$ each independently represents hydrogen, or a substituted or unsubstituted alkyl or aryl group. When $R_2$ and $R_3$ are alkyl, $CH_2OR_7$ or $CH_2OC(O)R_7$ groups, and $R_7$ is a substituted or unsubstituted alkyl or aryl group, it is preferred that $R_2$ and $R_3$ comprise from 3 to 8 carbon atoms. When $R_7$ is a heteroatom containing group, it is preferred that $R_2$ and $R_3$ comprise from 4 to 12 carbon atoms. $R_7$ may contain, for example, a morpholino, imidazole, triazole or tetrazole group, or a sulfide or ether linkage.

$R_4$ and $R_5$ each independently represents hydrogen, a substituted or unsubstituted alkyl group having from 1 to 8 carbon atoms, or a substituted or unsubstituted aryl group having from 6 to 10 carbon atoms. Preferably $R_4$ and $R_5$ each represents hydrogen. It is also possible that $R_3$ and $R_4$ may be joined by the necessary atoms to together form a 5- or 6-membered carboxylic or heterocyclic ring system.

$R_6$, which may be present in the ortho, meta or para positions of the aromatic ring, is any substituent which does not interfere with the required log partition coefficient or the functionality of the ETA. In one embodiment $R_6$ independently represents hydrogen, halogen, a substituted or unsubstituted alkyl group having from 1 to 8 carbon atoms, a substituted or unsubstituted alkoxy group having from 1 to 8 carbon atoms, a substituted or unsubstituted alkylthio group having 1 to 8 carbon atoms, amido (—NHCO—), sulfonamido (—$NHSO_2$—), or a heteroatom containing group or ring. Preferably $R_6$ is hydrogen, halogen, a substituted or unsubstituted alkyl group having from 1 to 8 carbon atoms, a substituted or unsubstituted alkoxy group having from 1 to 8 carbon atoms or a amido group having from 1 to 8 carbon atoms. m is 0 to 5. When m is greater than 1, the $R_6$ substituents can be the same or different or can be taken together to form a carbocyclic or heterocyclic ring.

A more preferred form of the compound of Formula (IIa) is shown in Formula (IV):

Formula (IV)

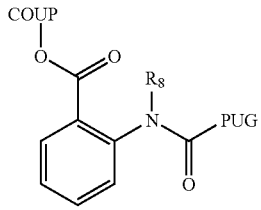

where COUP represents a moiety that reacts with oxidized developer to form a stable or unstable dye, $R_8$ is an alkyl group and PUG is as defined above. In Formula (IV), it is highly desirable that COUP is either a naphthol or acetoanilide based coupler and that PUG is either an inhibitor of silver development or an ETA fragment. It is most preferred that $R_8$ is a methyl group.

When COUP is a naphthol coupler, the most preferred forms for the compounds of the invention are according to Formula (IVa):

Formula (IVa)

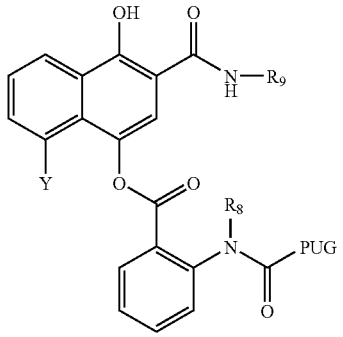

where Y is hydrogen or a substituted nitrogen and $R_9$ is hydrogen, an alkyl or aryl group. Typically, when $R_9$ is hydrogen or an alkyl or aryl group with less than 7 carbon atoms, the resulting cyan dye is not stable to the processing conditions and contributes no significant amount of red density after processing. However, when $R_9$ is an alkyl or aryl group with greater than 7 carbon atoms, the resulting cyan dye is generally stable and provides red density.

When COUP is an acetoanilide coupler, the most preferred forms for the compounds of the invention are according to Formula (IVb):

Formula (IVb)

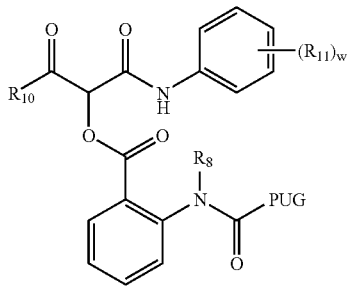

where $R_8$ is as described above, $R_{10}$ is alkyl, aryl or substituted nitrogen; $R_{11}$ is independently chosen from among chloro, alkyloxy, sufamoyl, sulfonamido, carbamoyl, carbonamido, ester, carboxylic acid or sulfonic acid groups; and w is 1 to 5. In these examples, the yellow dye formed is stable to the processing conditions and provides blue density. In order to form a dye that is removed during processing, it is generally necessary that at least one $R_{11}$ be a water solubilizing group such as carboxylic or sulfonic acid.

The following are some specific examples of the compounds that fall with the scope of the invention:

AA-1:

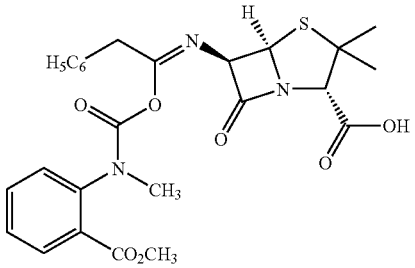

(releases penicillin, an antibiotic)

AA-2:

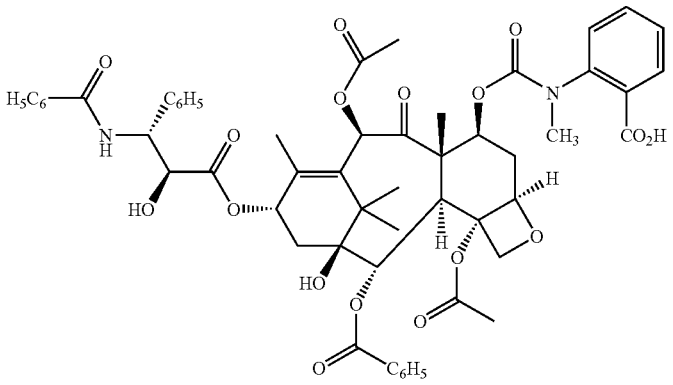

(releases taxol, an anti-tumer agent)

-continued
AA-3:
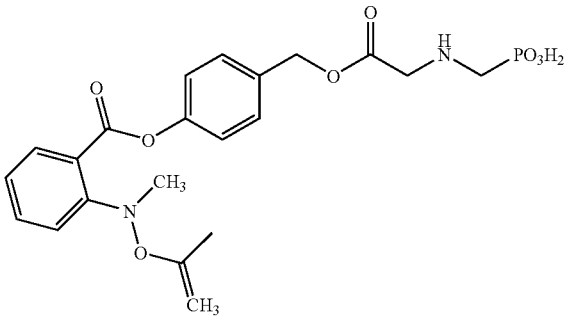
(releases glyphosate, an herbicide)
AA-4:
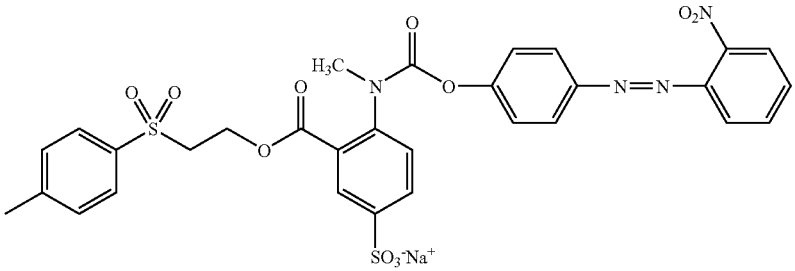
(releases an indictor dye)
AA-5:
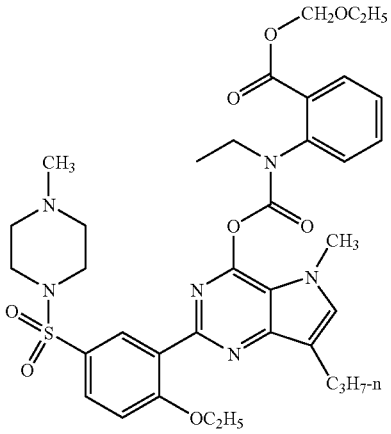
(releases Sildenafil, a hardening agent)
AA-6:
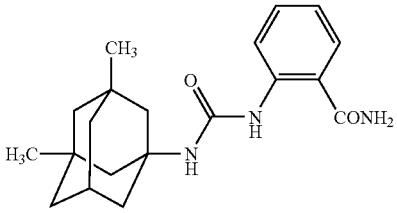
(releases Memantine, a treatment for Alzheimer's disease)

-continued
AA-7:
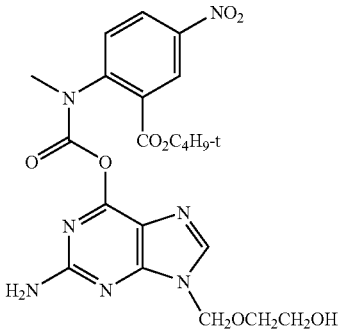
(releases Acyclovir, an anti-viral agent)
AA-8:
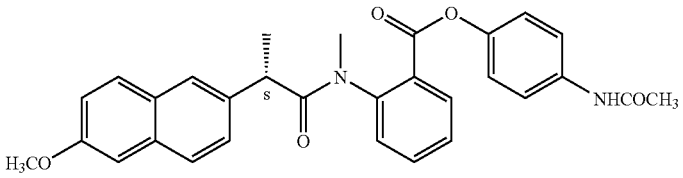
(releases d-Naproxen and Acetaminophen, analgesics)
AA-9:
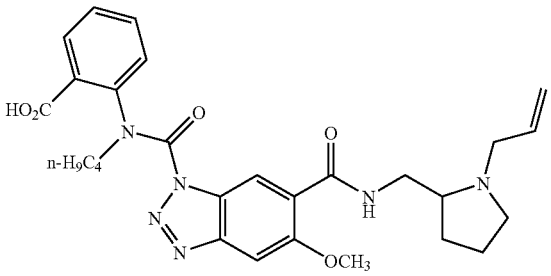
(releases Alizapride, a neuroleptic drug)
AA-10:
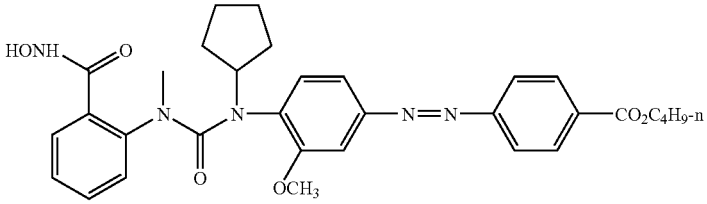
(releases in indicator dye)

-continued
AA-11:
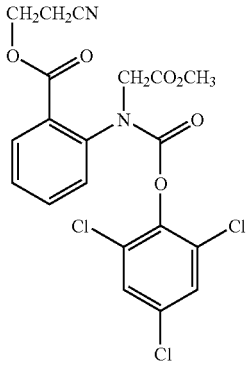
(releases trichlorophenol, an antiseptic
AA-12:
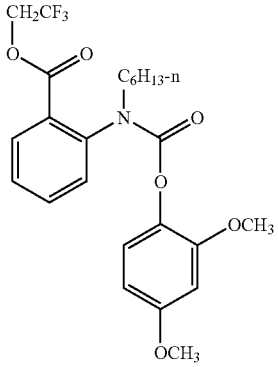
(releases vanillin, a fragrance)
The following are some examples of the compounds used in the photographic embodiment of the invention:
AAC-1:
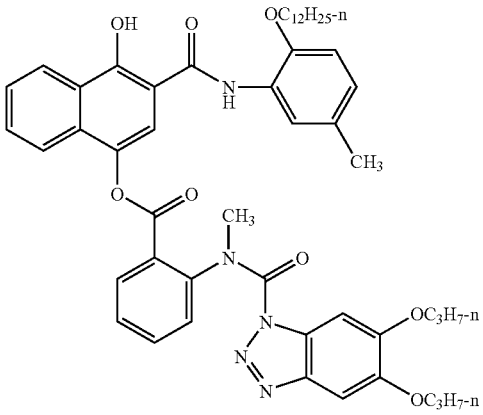

-continued
AAC-2:
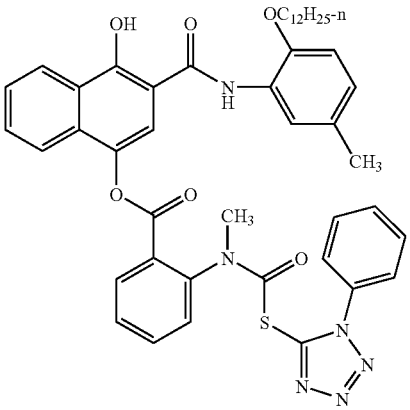
AAC-3:
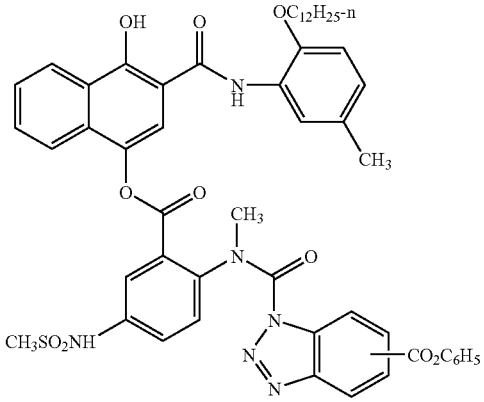
AAC-4:
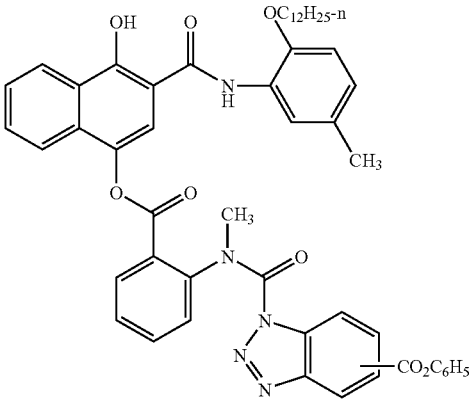

-continued
AAC-5:
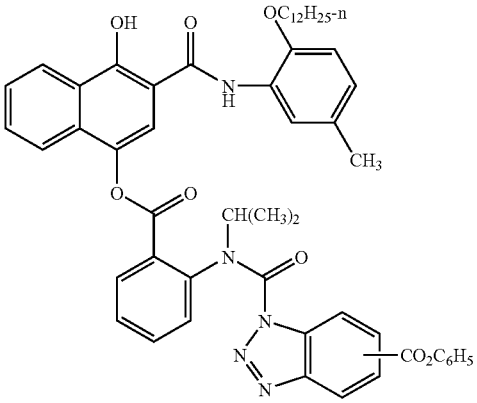
AAC-6:
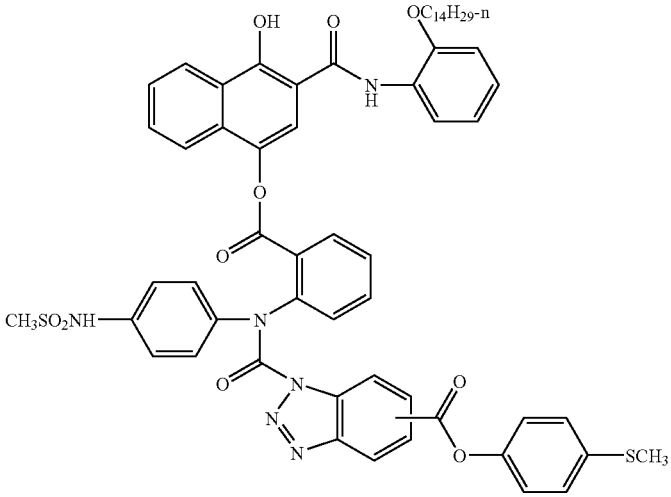
AAC-7:
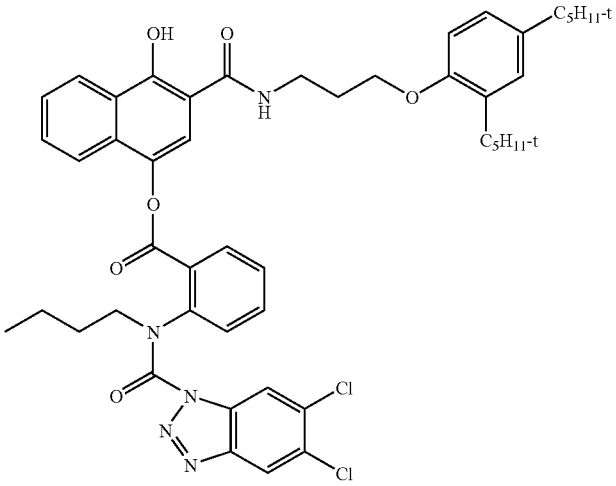

-continued
AAC-8:
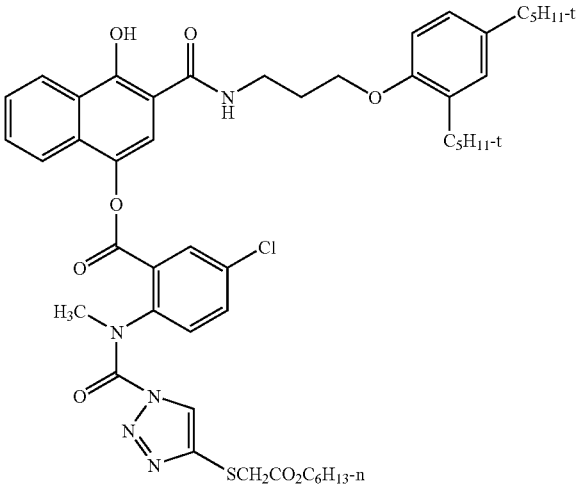
AAC-9:
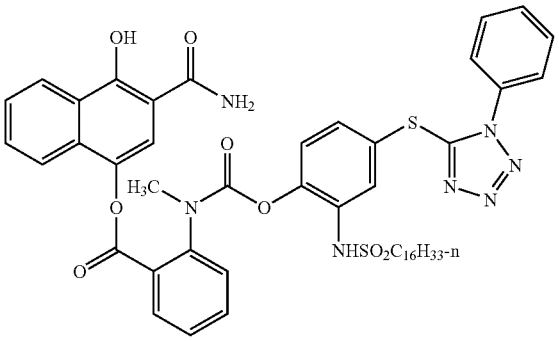
AAC-10:
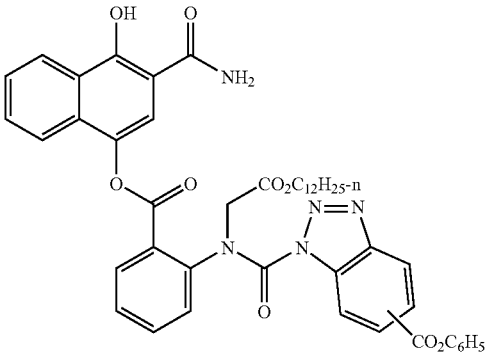

-continued
AAC-11:
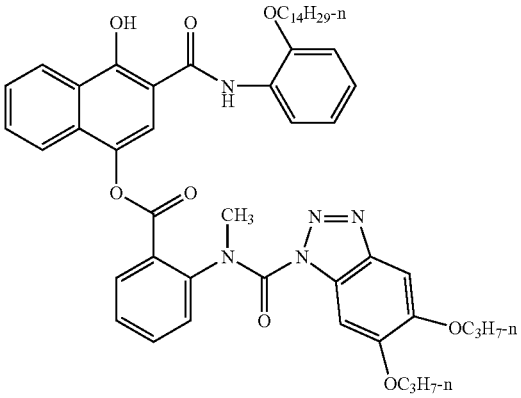
AAC-12:
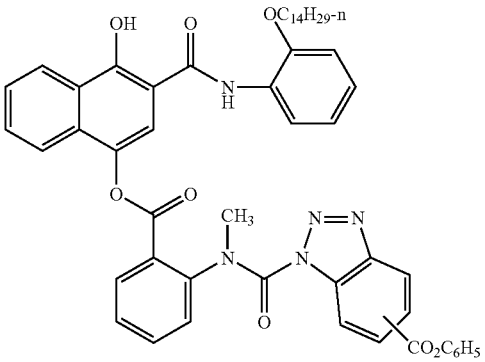
AAC-13:
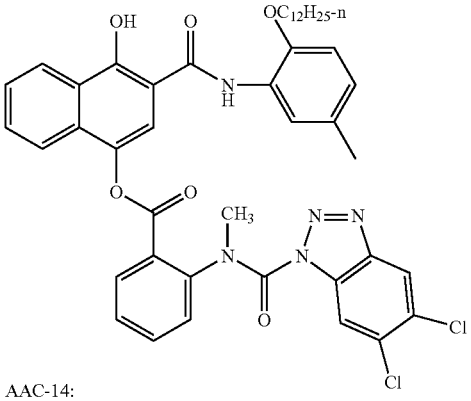
AAC-14:
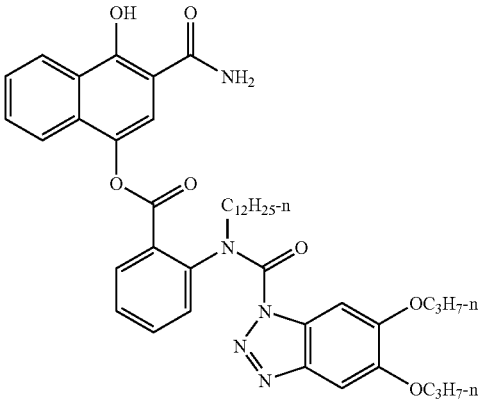

-continued
AAC-15:
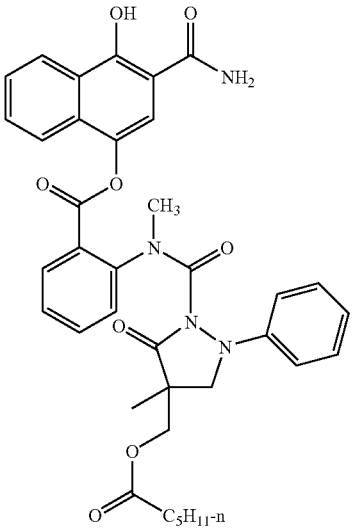
AAC-16:
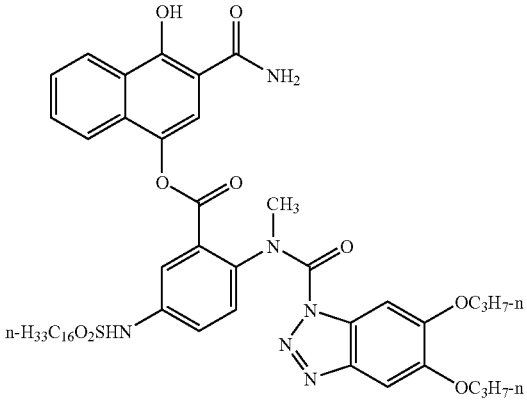
AAC-17:
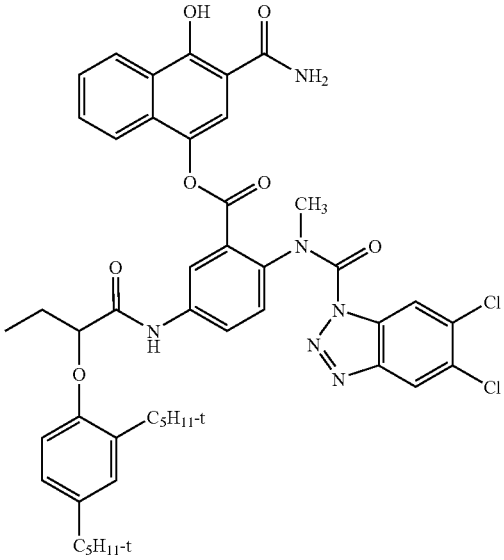

-continued
AAC-18:
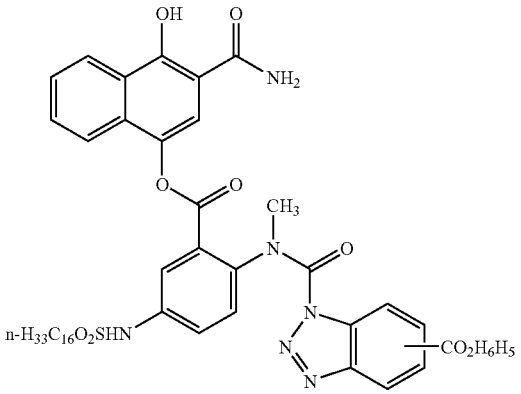
AAC-19:
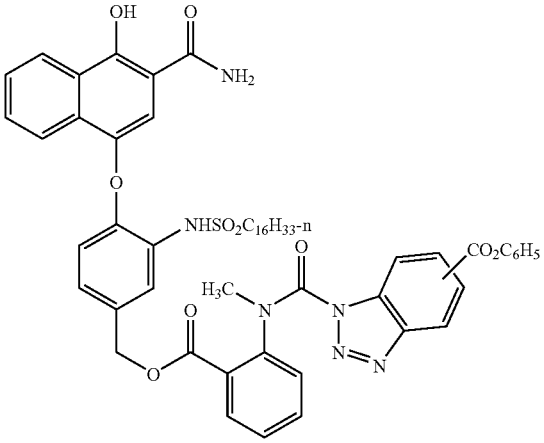
AAC-20:
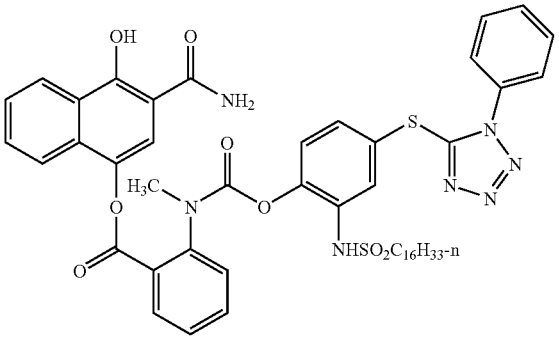

-continued
AAC-21:
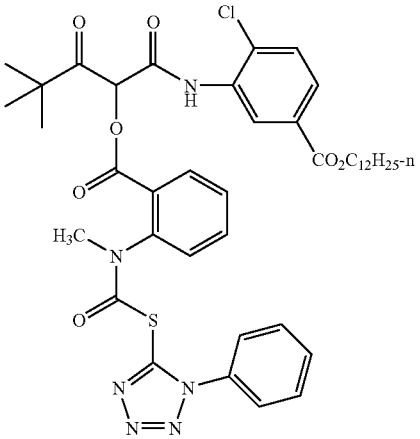
AAC-22:
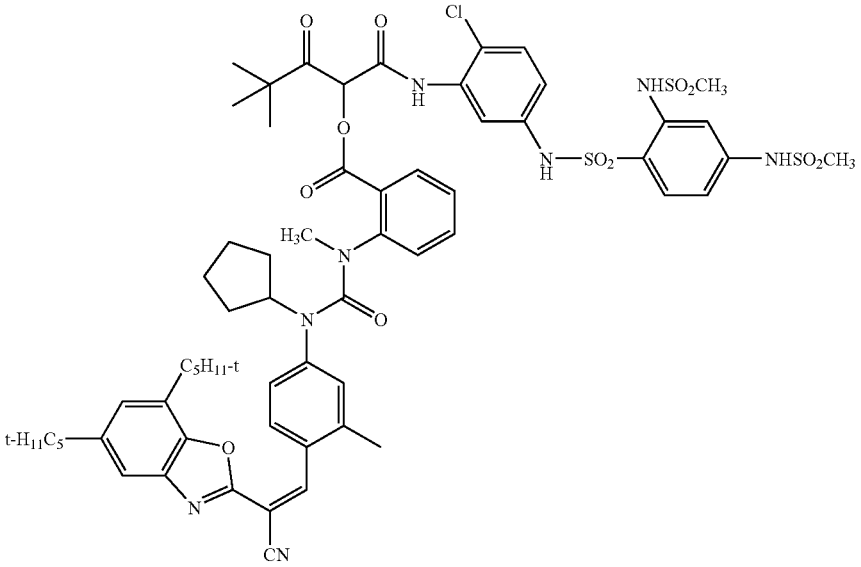
AAC-23:
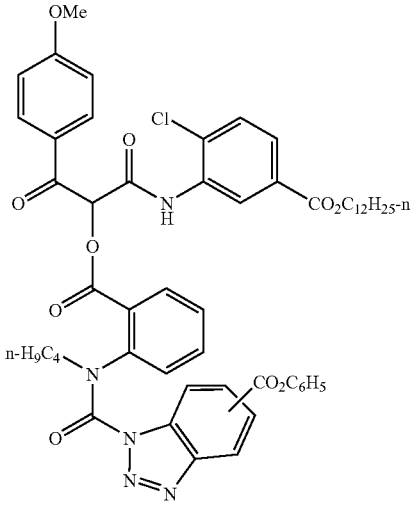

-continued
AAC-25:
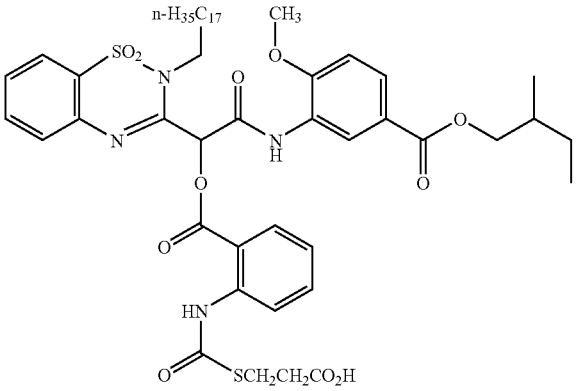
AAC-26:
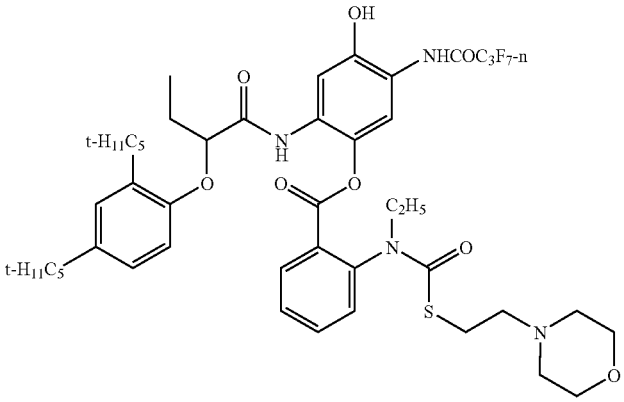
AAC-27:
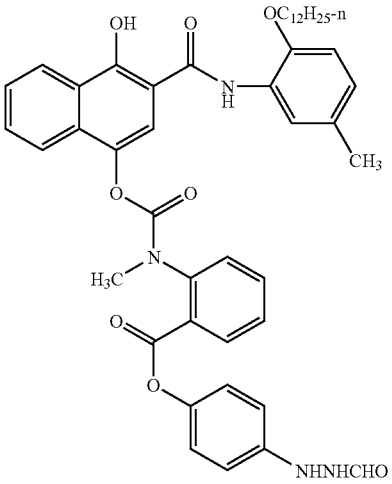

-continued
AAC-28:
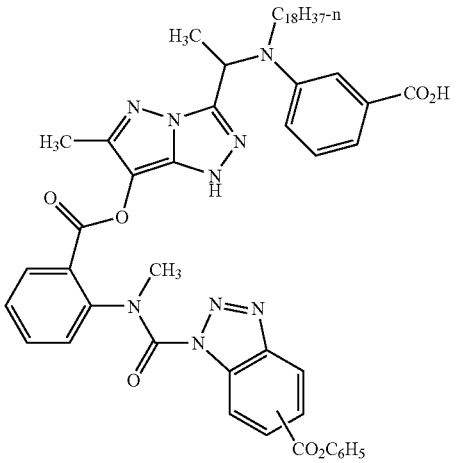
AAC-29:
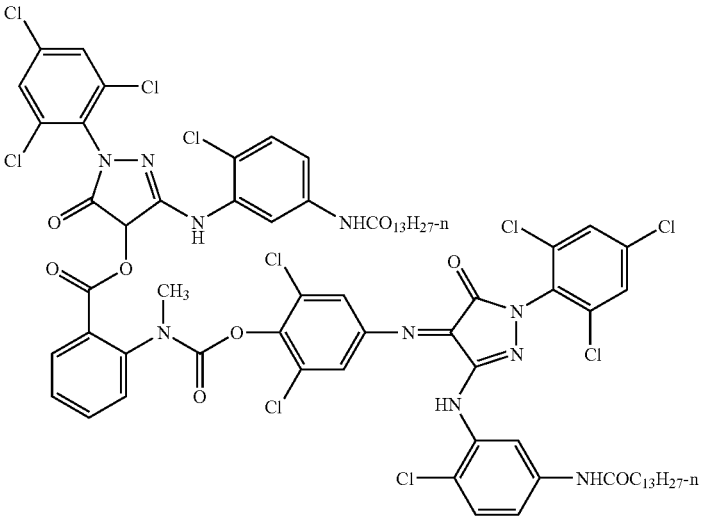
AAC-30:
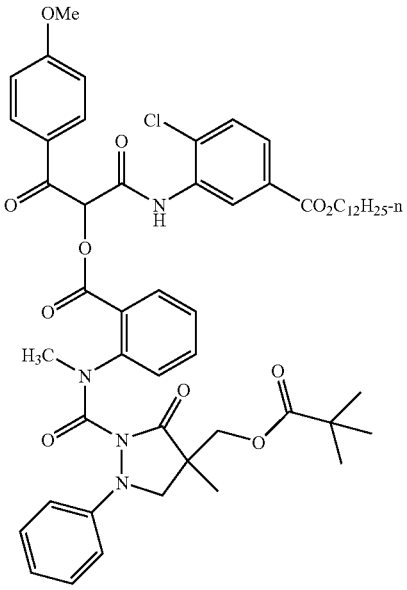

-continued
AAC-31:
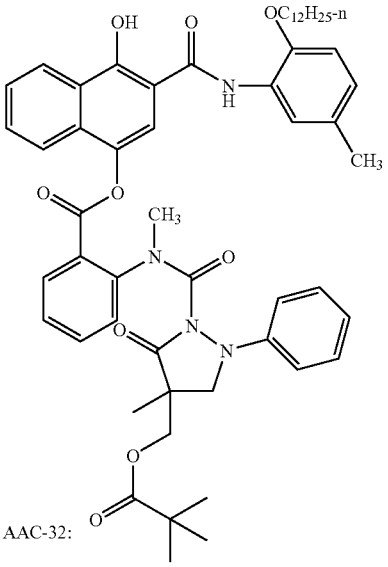
AAC-32:
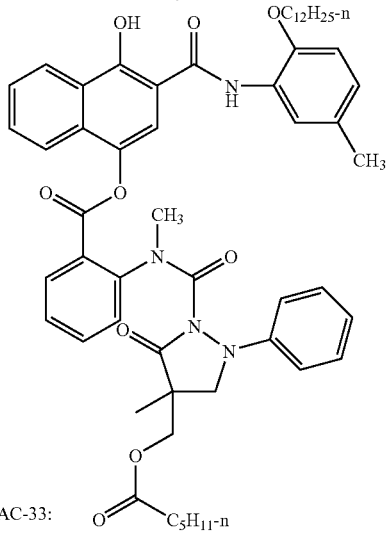
AAC-33:
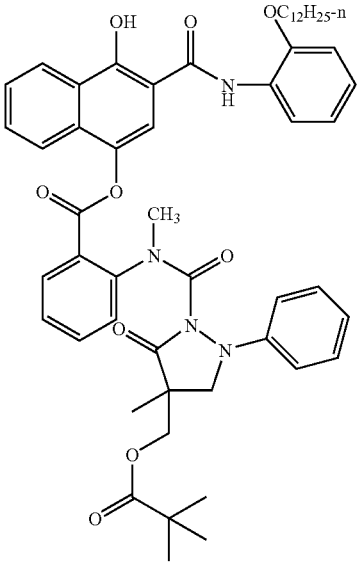

-continued
AAC-34:
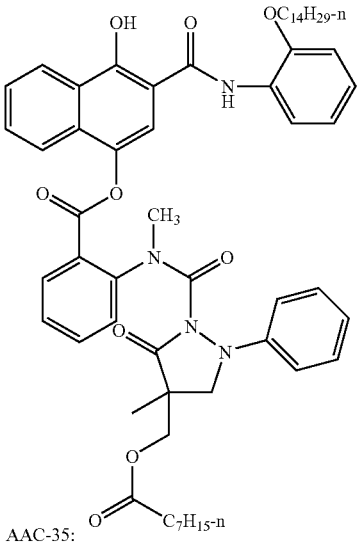
AAC-35:
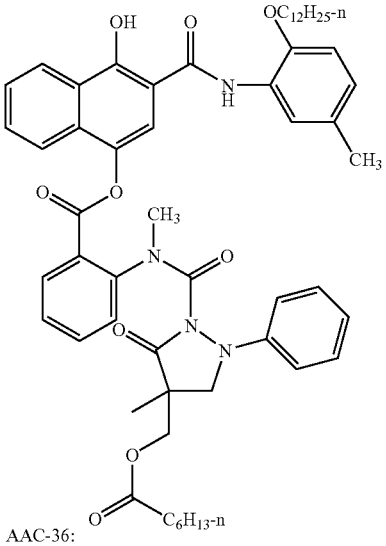
AAC-36:
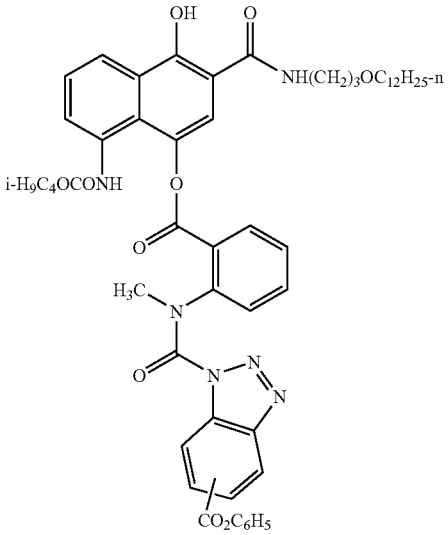

For the compounds of the invention, it should be appreciated that the amount used is a function of other variables such as the requirements of the particular application or process and the ultimate concentration of the UG required to produce the desired effect. For photographic embodiments, the amount used in film elements also depends on many factors such as the solvent used, film dimensions, the nature of the PUG used and the magnitude of the improvements desired. Typically, the compounds are used in either an imaging or non-imaging layer in the range of 0.001 to 1 $g/m^2$ or more preferably, 0.01 to 0.1 $g/m^2$.

The PUG releasing compounds may be added to or contained in any layer of the photographic element where they are in reactive association with the silver halide emulsion. By "in reactive association with" it is meant that the compounds must be contained in the silver halide emulsion layer or in a layer whereby they can react or interact with, or come in contact with the silver halide emulsion. For example, the compounds can also be added to gelatin-only overcoats or interlayers. In one embodiment the compound is contained in the silver halide emulsion layer. In another embodiment the compound is located in a layer adjacent to an imaging layer, particularly in a non-light sensitive layer adjacent to the silver halide emulsion layer.

In the particular case of the compounds of Formula (IV) when PUG is either an inhibitor or an ETA fragment, the compounds of the invention are preferably used in the most light sensitive layer when two or more layers of differing red-light sensitivity are present. When the PUG is an inhibitor, it is also possible to use the DIARs of the invention in conjunction with other types of known DIRs and DIARs, either in the same layer or in different layers. In the specific example of Formula (IVa) where $R_9$ is hydrogen or an alkyl group or aryl group with less than 7 carbon atoms, the compound is preferably used in a green-light sensitive layer and most preferably, in the most green-light sensitive layer.

The compounds used in the invention can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. The materials are not water-soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, alcohols and esters. When a solvent is present, it is preferred that the weight ratio of compound to solvent be at least 1 to 0.5, or most preferably, at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials used in the invention may also be dispersed as an admixture with another component of the system such as a coupler or an oxidized developer scavenger so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy) acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In one embodiment of the invention the emulsion containing the dye layered grains containing the antenna dye described herein is in the magenta dye forming unit. Particularly useful is a silver halide photographic element wherein the silver halide photographic element further comprises a yellow filter dye in a layer between the support and the green sensitized layer closest to the support. A preferred dye is shown below.

YFD-1

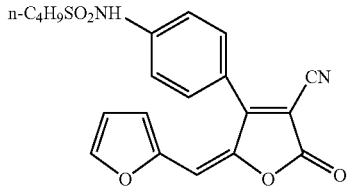

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. A particularly useful support for small format film is annealed polyethylenenaphthlate.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. More preferably the elements are negative working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

The following discussion relates to any additional coupling species present in the film element in conjunction with the compounds of the invention.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466, 728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895, 826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311, 082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213, 490; Japanese Published Application 58-172,647; U.S. Pat. Nos. 2,983,608; 4,070,191; and 4,273,861; German Applications DE 2,706,117 and DE 2,643,965; U.K. Patent 1,530, 272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

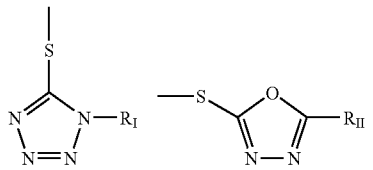

-continued

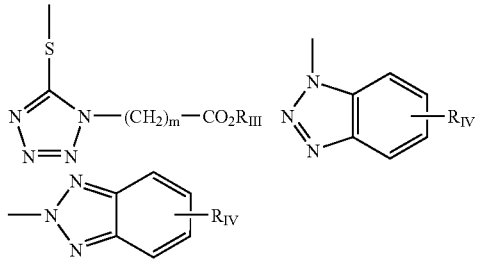

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

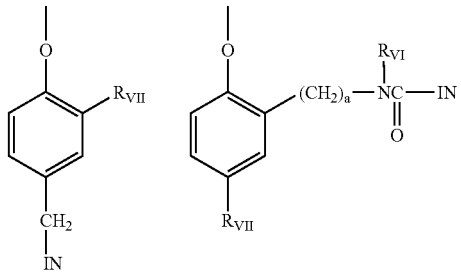

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

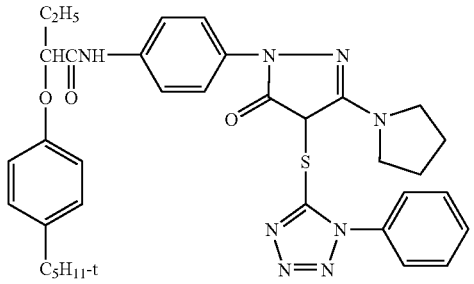

D2

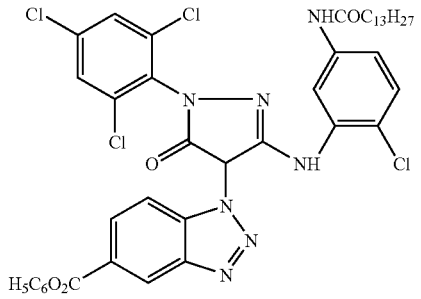

D3

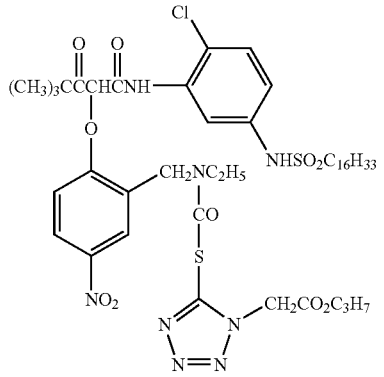

D4

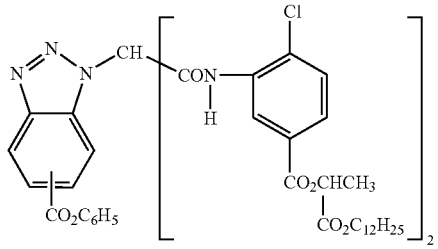

-continued

D5

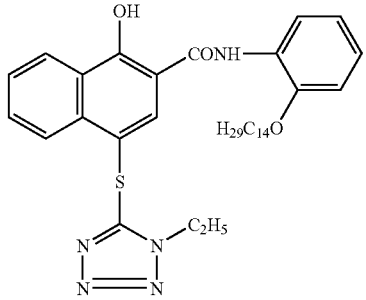

D6

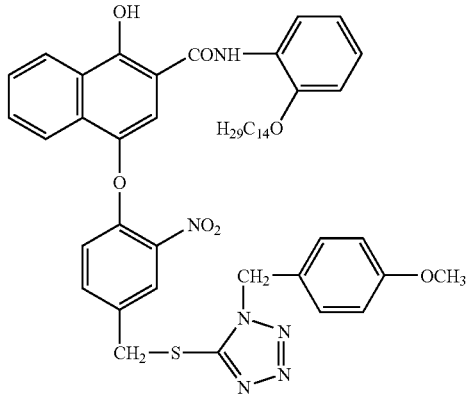

D7

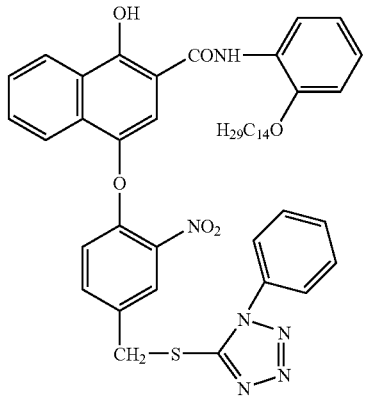

D8

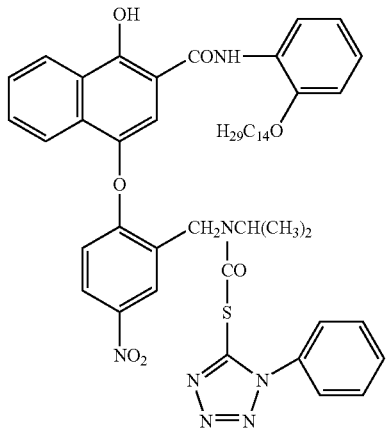

-continued

D9

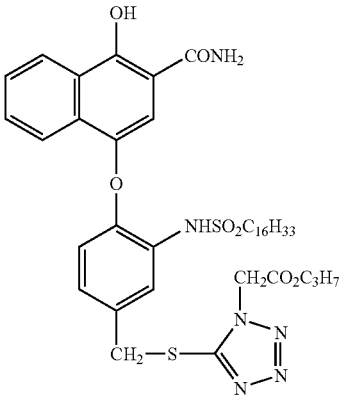

D10

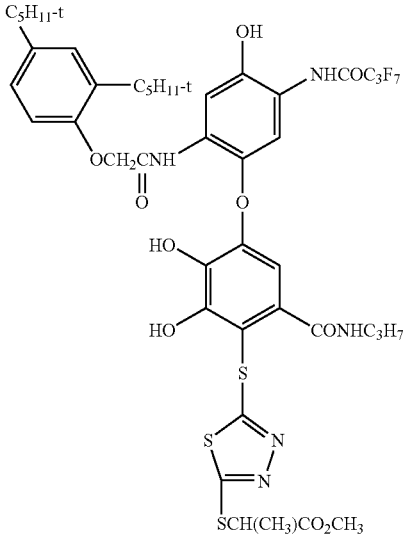

D11

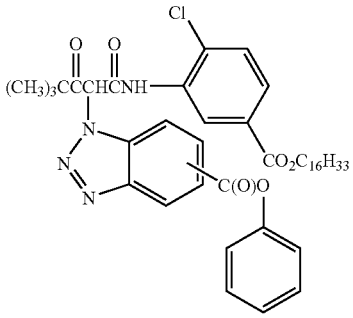

D12

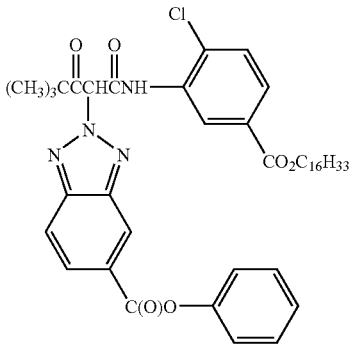

The silver halide used in the photographic elements may be silver iodobromide, silver bromide, silver chloride, silver chlorobromide, silver chloroiodobromide, and the like. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* 4$^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 μm. Most preferably the average thickness of the tabular grains is less than 0.2 μm. In a specific preferred form the tabular grains are ultrathin—that is, their average thickness is less than 0.07 μm.

The useful average grain ECD of a tabular grain emulsion can range up to about 15 μm. Except for a very few high speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,621, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are here incorporated by reference.

Preferred high chloride tabular grain emulsions are {100} tabular grain emulsions, as illustrated by the following patents, here incorporated by reference: Maskasky U.S. Pat. Nos. 5,264,337, 5,292,632, 5,275,930, 5,607,828 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904, 5,663,041, and 5,744,297, Budz et al U.S. Pat. No. 5,451,490, Reed et al U.S. Pat. No. 5,695,922, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 4,173,320 and 5,411,851 5,418,125, 5,492,801, 5,604,085, 5,620,840, 5,693,459, 5,733,718, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175, 5,612,176 and 5,614,359, and Irving et al U.S. Pat. Nos. 5,695,923, 5,728,515 and 5,667,954, Bell et al U.S. Pat. No. 5,132,203, Brust U.S. Pat. Nos. 5,248,587 and 5,763,151, Chaffee et al U.S. Pat. No. 5,358,840, Deaton et al U.S. Pat. No. 5,726,007, King et al U.S. Pat. No. 5,518,872, Levy et al U.S. Pat. No. 5,612,177, Mignot et al U.S. Pat. No. 5,484,697, Olm et al U.S. Pat. No. 5,576,172, Reed et al U.S. Pat. Nos. 5,604,086 and 5,698,387.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti et al., U.S. Pat. No. 4,937,180, and Johnson et al., U.S. Pat. No. 5,164,292. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following examples are intended to illustrate, but not to limit the invention:

EXAMPLES

Synthesis Examples

Preparation of 2-methylamino-benzoic acid, 3-(2-dodecyloxy-5-methyl-phenylcarbamoyl)-4-hydroxy-naphthalen-1-yl ester [A]

N-Methylisatoic anhydride (18.00 g, 90% technical grade containing mineral oil) was suspended in hexane (300 ml) and stirred for 0.75 hr at room temperature. The solid was filtered under suction, washed with petroleum ether (40–60° C.) and dried briefly before use. 1,4-Dihydroxy-naphthalene-2-carboxylic acid (2-dodecyloxy-5-methyl-phenyl)-amide was recrystallised from a mixture of petroleum ether (60–80° C.) and toluene before use. N,N-Diisopropylethylamine (16.20 g, 0.125 mol) was added to a stirred suspension of 1,4-dihydroxy-naphthalene-2-carboxylic acid (2-dodecyloxy-5-methyl-phenyl)-amide (29.14 g, 0.061 mol) and N-methylisatoic anhydride (12.00 g {of 90%}, 0.061 mol) in tetrahydrofuran (150 ml, dried over 4 Å molecular sieves) under an atmosphere of argon. The reaction was heated to reflux overnight. An aliquot was removed, added to dilute hydrochloric acid and extracted with ethyl acetate. Thin layer chromatography indicated the presence of a small amount of residual starting naphthol. A further quantity of N-methylisatoic anhydride (1.1 g) was added and the reflux continued for a further 18 hr. The reaction was allowed to cool and then the solvent was removed under reduced pressure. The residue was taken-up in a mixture of dilute aqueous (2 M) hydrochloric acid (500 ml) and warm ethyl acetate (1000 ml). Some material failed to dissolve and collected at the interface. The buff solid was filtered, washed with ethyl acetate and dried in vacuo (27.3 g). The organic solution was separated and dried over anhydrous magnesium sulfate, filtered and concentrated under reduced pressure. Methanol (100 ml) was added and the mixture stirred and boiled under reflux for 15 min and then allowed to cool. A further quantity of a solid precipitated which was filtered and dried in vacuo (3.8 g). The solids were analysed and the results were consistent with the desired 2-methylamino-benzoic acid 3-(2-dodecyloxy-5-methylphenylcarbamoyl)-4-hydroxy-naphthalen-1-yl ester. The total yield of product was 31.1 g (83%).

Preparation of 1H-benzotriazole-5-carboxylic acid, phenyl ester compound with formyl chloride [B]

To a solution of phosgene in toluene (20%, 3.6 ml, 7.20 mmol) and dry tetrahydrofuran (THF)(20 ml) was added dropwise a solution of 1H-benzotriazole-5-carboxylic acid phenyl ester (1.26 g, 5.30 mmol) in dry THF (30 ml) in a flask suspended in an ice/salt bath. The temperature was maintained at 0° C. during addition. The reaction mixture was stirred at 5–10° C. for 60 min and then room temperature for a further 10 min. The resulting solution was concentrated under reduced pressure at room temperature initially with a water pump and then with a high vacuum pump. Analysis of the resulting pale brown solid (1.60 g, 100%) by infra-red spectroscopy was consistent with the desired product and this was used without further purification

Preparation of 1-({2-[3-(2-Dodecyloxy-5-methyl-phenylcarbamoyl)-4-hydroxy-naphthalen-1-yloxy-carbonyl]-phenyl}-methyl-carbamoyl)-benzotriazole-5-carboxylic acid, phenyl ester (mixture of 1H and 3H triazole isomers)(AAC-4)

1H-Benzotriazole-5-carboxylic acid phenyl ester, compound with formyl chloride(15.4 g, 0.051 mol) was dissolved in THF (200 ml) and added dropwise during 20 min to a solution of 2-methylamino-benzoic acid 3-(2-dodecyloxy-5-methyl-phenylcarbamoyl)-4-hydroxy-naphthalen-1-yl ester (31.1 g, 0.051 mol) and N,N-dimethylaniline (11.8 g, 0.097 mol) in THF (120 ml). The solution was stirred overnight. Liquid chromatography coupled to mass spectrometry indicated that the major product was the desired coupler, present as a mixture of two isomers. The solvent was removed by evaporation under reduced pressure and the crude oil re-dissolved in ethyl acetate (900 ml). The solution was washed with aqueous 2 M hydrochloric acid (500 ml) and then water (500 ml) in a separating funnel, separated, dried over anhydrous magnesium sulfate, filtered and re-evaporated to give a brownish gum. The residue was re-dissolved by warming in acetonitrile (500 ml), using a steam bath. This solution was then stirred for 60 hr at room temperature. A beige solid formed which was filtered and dried under vacuo. Analysis was consistent with the desired product as a mixture of 1H and 3H triazole isomers. The total yield of product was 39.6 g (88%).

Preparation of 2-methylamino-benzoic acid, 3-(2-dodecyloxy-5-methyl-phenylcarbamoyl)-4-hydroxy-naphthalen-1-yl ester compound with formyl chloride [D]

To a solution of 2-methylamino-benzoic acid, 3-(2-dodecyloxy-5-methyl-phenylcarbamoyl)-4-hydroxy-naphthalen-1-yl ester (3.17 g, 0.0052 mol) in tetrahydrofuran (80 ml) in a round bottomed flask was slowly added a solution of phosgene in toluene (7.7 ml of ~20%, 0.016 mol) with stirring at 0° C. under argon atmosphere. The mixture was stirred for 5 hr and allowed to reach room temperature (~22° C.) during this time. The solution was evaporated under vacuo using a rotary vacuum pump at room temperature to give a buff semi-solid (3.5 g, 100%). Analysis was consistent with the desired chloride.

Preparation of 2-[Methyl-(1-phenyl-1H-tetrazol-5-ylsulfanylcarbonyl)-amino]-benzoic acid, 3-(2-dodecyloxy-5-methyl-phenylcarbamoyl)-4-hydroxy-naphthalen-1-yl ester (AAC-2)

The chloride [D], from above, (3.50 g, 0.0052 mol) was dissolved in tetrahydrofuran (80 ml) and stirred under argon atmosphere at room temperature (~22° C.). 1-Phenyl-1H-tetrazole-5-thiol, sodium salt (1.06 g, 0.0053 mol) was added followed by N,N-dimethylaniline (3.5 ml, 0.027 mol) and the mixture was stirred overnight. The reaction mixture was then heated to 55° C. for 2 hr. The mixture was cooled and evaporated under reduced pressure to give a brown oil. The oil was diluted with ethyl acetate (200 ml) and washed sequentially with 2 M aqueous hydrochloric acid (70 ml) and water (100 ml). The organic layer was separated, dried over magnesium sulfate, filtered and evaporated to give a brown oil which contained 3 components. The oil was chromatographed on a Flashpak Si 50 g column eluting with hexane/ethyl acetate (4:1->2:1). The higher running components were discarded. The more polar component was evaporated to give a buff solid. Analysis was consistent with 2-[methyl-(1-phenyl-1H-tetrazol-5-ylsulfanylcarbonyl)-amino]-benzoic acid 3-(2-dodecyloxy-5-methyl-phenylcarbamoyl)-4-hydroxy-naphthalen-1-yl ester. The total yield of product was 2.5 g (58%).

Preparation of hexanoic acid, 2-chlorocarbonyl-4-methyl-3-oxo-1-phenyl-pyrazolidin-4-ylmethyl ester [F]

A solution of hexanoic acid, 4-methyl-3-oxo-1-phenyl-pyrazolidin-4-ylmethyl ester (0.74 g, 0.0024 mol) and N,N-diisopropylethylamine (0.36 g, 0.0028 mol) in dichloromethane (8 ml) was added dropwise over 30 min to a stirred solution of a 20% phosgene in toluene solution (1.5 ml, 0.0028 mol) and dichloromethane (8 ml) under an atmosphere of argon. The reaction mixture was cooled using an acetone-solid carbon dioxide bath such that the initial temperature was −30° C. and the reaction remained below −20° C. during the addition. The reaction was stirred for 2 hr at between −30° C. and −20° C. Dilute aqueous hydrochloric acid (8 ml) was added to the cold reaction. The organic layer was washed with saturated aqueous sodium chloride (8 ml), dried over magnesium sulfate, and concentrated in vacuo to give a yellow viscous oil. Analysis was consistent with the desired product. The total yield of product was 0.83 g (96%).

Preparation of 2-[(4-hexanoyloxymethyl-4-methyl-5-oxo-2-phenyl-pyrazolidinone-1-carbonyl)-methylamino]benzoic acid, 3-(2-dodecyloxy-5-methylphenylcarbamoyl)-4-hydroxynaphthalen-1-yl ester (AAC-32)

Hexanoic acid, 2-chlorocarbonyl-4-methyl-3-oxo-1-phenyl-pyrazolidin-4-ylmethyl ester (0.80 g, 0.0022 mol) was dissolved in tetrahydrofuran (10 ml) and added to a stirred solution of 2-methylamino-benzoic acid, 3-(2-dodecyloxy-5-methyl-phenylcarbamoyl)-4-hydroxy-naphthalen-1-yl ester [A] (1.28 g, 0.0021 mol) and N,N-dimethylaniline (0.28 g, 0.0023 mol) in dry tetrahydrofuran (5 ml) and the solution stirred for 72 hr under argon atmosphere in a flask equipped with a reflux condenser to limit evaporation. The reaction mixture was evaporated, re-dissolved in ethyl acetate (300 ml) and washed with 2 M aqueous hydrochloric acid (150 ml) followed by water (20 ml). The organic extract was dried over anhydrous magnesium sulfate, filtered and evaporated to give a yellow-brown oil which contained product and starting amine. The oil was chromatographed on a Flashpak Si 50 g column eluting with hexane/ethyl acetate (4:1->2:1). The higher running components were discarded. The more polar component was evaporated to give pale yellow viscous oil. Analysis was consistent with the desired product. The total yield of product was 1.3 g (62%).

Photographic Examples

Single Layer Film Example 1

Yellow ETA releasing couplers (ETARCs) of the present invention (and control compounds) were dispersed in coupler solvent and incorporated into photographic coatings containing a silver bromoiodide emulsion, on a transparent cellulose acetate support (with Gel U-coat and removable carbon antihalation backing), according to the following (all laydown in g/m$^2$ unless otherwise noted):

Overcoat: Gelatin at 1.0 and bis(vinylsulphonyl)methane hardener at 0.166.

Emulsion Layer: Light-sensitive silver bromoiodide at 0.807, image coupler Y-1 at 0.350, AAC-30 at 0.187 mmol/m$^2$ and gelatin at 2.42.

A comparative coating was prepared in which the image coupler was coated at 0.420 g/m$^2$ and the AAC-30 was omitted.

Aqueous dispersions of the couplers were prepared by methods known in the art. The yellow dye-forming coupler dispersions contained 6% by weight of gelatin, 9% by weight of coupler and a 1.0:0.5:1.5 weight ratio of coupler to di-n-butyl phthalate coupler solvent to cyclohexanone auxiliary solvent. The yellow ETARC dispersions contained 6% by weight of gelatin, 2% by weight of coupler and a 1.0:2.0:3.0 weight ratio of coupler to di-ethyl lauramide coupler solvent to 2-(2-butoxyethoxy)ethyl acetate auxiliary solvent. In each case the auxiliary solvent was included to aid in dispersion preparation and was removed by washing the dispersion for 6 hrs at 4° C. and pH 6.0.

The single layer photographic coatings prepared in this way were slit and chopped into 30 cm×35 mm test strips. After hardening the strips were exposed (0.01 sec) through a 0–4.0 neutral density step wedge (0.2 ND step increments) and Daylight V and Wratten 99 filters then processed through a standard KODAK FLEXICOLOR™ (C-41) process as described in the British Journal of Photography Annual (1988) 196–198 using the following steps and process times: Developer (2.5 min); Bleach (4.0 min); Wash (2.0 min); Fix (4.0 min) and Wash (2.0 min).

The processed images were read with blue light to determine the gamma (the maximum slope between any two density points) and relative speed (the exposure point +0.15 units above Dmin divided by the same point for SL-1). Results are shown in Table 1.

TABLE 1

| Yellow ETA Releasing Compounds | | | | |
|---|---|---|---|---|
| Sample | Comparative or Invention | ETA Compound | Gamma | Relative Speed |
| SL-1 | Comp | None | 0.58 | 1.000 |
| SL-2 | Invention | AAC-30 | 0.78 | 1.012 |

Clearly, the yellow ETA releasing compound is giving a gamma and speed benefit relative to an equivalent amount of yellow image coupler and demonstrates efficient release of an ETA fragment in an imagewise fashion.

Single Layer Film Example 2

Cyan ETA releasing couplers (ETARCs) of the present invention (and control compounds) were dispersed in coupler solvent and incorporated into photographic coatings SL-3 to SL-9 on a transparent cellulose acetate support (with Gel U-coat and removable carbon antihalation backing), according to the following:

Overcoat: Gelatin at 1.0 and bis(vinylsulphonyl)methane hardener at 0.166.

Emulsion Layer: Red-sensitized silver bromoiodide at 0.807, image coupler C-1 at 0.269, ETARC at 0.187 mmol/$m^2$ and gelatin at 2.42.

Comparative coatings were prepared in which the image coupler was coated at 0.323 g/$m^2$ and the ETARC was omitted.

Aqueous dispersions of the couplers were prepared by methods known in the art. The cyan dye-forming coupler dispersions contained 8% by weight of gelatin, 6% by weight of coupler and a 1:1:2 weight ratio of coupler to di-n-butyl sebacate coupler solvent to ethyl acetate auxiliary solvent. The auxiliary solvent was included to aid in dispersion preparation and was removed by evaporation. The cyan ETARC dispersions contained 6% by weight of gelatin, 2% by weight of coupler and a 1:2:3 weight ratio of coupler to di-ethyl lauramide coupler solvent to 2-(2-butoxyethoxy) ethyl acetate auxiliary solvent. The auxiliary solvent was included to aid in dispersion preparation and was removed by washing the dispersion for 6 hrs at 4° C. and pH 6.0.

The single layer photographic coatings prepared in this way were slit and chopped into 30 cm×35 mm test strips. After hardening the strips were exposed (0.01 sec) through a 0–4.0 neutral density step wedge (0.2 ND step increments) and Daylight V and Wratten 9 and 1.0 ND filters then processed through a standard KODAK FLEXICOLOR™ (C-41) process as described above. The processed images were read with red light to determine the gamma (the maximum slope between any two density points) and relative speed (the exposure point divided by the same point for SL-3 as computed as follows: the exposure required to produce a specified film density (Ds) in the toe of a sensitometric DlogE curve of 0.2×gradient (γ) at that density above $D_{min}$(i.e. $Ds=0.2\gamma+D_{min}$)). Results are shown in Table 2.

TABLE 2

| Cyan ETA Releasing Compounds | | | | |
|---|---|---|---|---|
| Sample | Comparative or Invention | ETA Compound | Gamma | Relative Speed |
| SL-3 | Comp | None | 0.68 | 1.000 |
| SL-4 | Comp | ETARC-1 | 0.48 | 1.046 |

TABLE 2-continued

| Cyan ETA Releasing Compounds | | | | |
|---|---|---|---|---|
| Sample | Comparative or Invention | ETA Compound | Gamma | Relative Speed |
| SL-5 | Invention | AAC-31 | 0.48 | 1.031 |
| SL-6 | Invention | AAC-33 | 0.47 | 1.041 |
| SL-7 | Invention | AAC-34 | 0.50 | 1.015 |
| SL-8 | Invention | AAC-32 | 0.43 | 1.036 |
| SL-9 | Invention | AAC-35 | 0.51 | 1.013 |

The results in Table 2 indicate that the inventive cyan ETA releasers give results similar to a known ETA releaser, thus indicating effective imagewise release of the desired ETA fragment.

Bilayer Film Example

Inhibitor releasing couplers (DIARs) of the present invention (and control compounds) were dispersed in coupler solvent and incorporated into the causer layer of model bilayer photographic coatings containing silver bromoiodide emulsions, on a transparent Cellulose Acetate support (with Gel U-coat and removable carbon antihalation Backing), according to the following coating diagram:

Overcoat: Gelatin at 1.0.

Causer Layer: One blue-sensitized silver bromoiodide emulsion at 0.592, a second blue-sensitized silver bromoiodide emulsion at 0.199, C-1 at 0.323, DIAR at 0.0648 mmol/$m^2$, gelatin at 1.6 and bis(vinylsulphonyl)methane hardener at 0.200.

Interlayer: Gelatin at 2.5, ILS-1 at 0.108 and YFD-1 at 0.108.

Receiver Layer: A green-sensitized silver bromoiodide emulsion at 0.807, M-1 at 0.448, D-5 at 0.0027 and gelatin at 1.6

Comparative coatings were prepared in which the DIAR was omitted from the causer layer.

Aqueous dispersions of the couplers were prepared by methods known in the art. The cyan dye-forming coupler dispersions contained 8% by weight of gelatin, 6% by weight of coupler and a 1:1:2 weight ratio of coupler to di-n-butyl sebacate coupler solvent to ethyl acetate auxiliary solvent. The auxiliary solvent was included to aid in dispersion preparation and was removed by evaporation. The cyan and universal DIAR dispersions contained 6% by weight of gelatin, 2% by weight of coupler and a 1:2:3 weight ratio of coupler to di-ethyl lauramide coupler solvent to 2-(2-butoxyethoxy)ethyl acetate auxiliary solvent. The auxiliary solvent was included to aid in dispersion preparation and was removed by washing the dispersion for 6 hrs at 4° C. and pH 6.0.

The single layer photographic coatings prepared in this way were slit and chopped into 30 cm×35 mm test strips. After hardening the strips were exposed (0.02 sec) through a 0–4.0 neutral density step wedge (0.2 ND step increments) and Daylight V and 0.53 ND and 0.2 magenta colour correction filters then processed through a standard KODAK FLEXICOLOR™ (C-41) process as described above. The processed images were read with green light to determine the gamma (the maximum slope between any two density points) in the receiver layer and with red light to determine the gamma (the maximum slope between any two density points) in the causer layer. Results are shown in Tables 3, 4 and 5 (Each Table is from a different experiment; differences in results between experiments is due to changes in emulsion in the receiver layer).

TABLE 3

Inhibitor Releasing Compounds

| Sample | Comparative or Invention | DIAR Compound | Receiver Gamma | Causer Gamma |
|---|---|---|---|---|
| BL-1 | Comp | None | 1.09 | 0.50 |
| BL-2 | Comp | D-8 | 0.77 | 0.38 |
| BL-3 | Invention | AAC-11 | 0.78 | 0.22 |
| BL-4 | Invention | AAC-12 | 0.68 | 0.24 |
| BL-5 | Comp | D-4 | 0.79 | 0.29 |
| BL-6 | Invention | AAC-14 | 0.89 | 0.30 |

TABLE 4

Inhibitor Releasing Compounds

| Sample | Comparative or Invention | DIAR Compound | Receiver Gamma | Causer Gamma |
|---|---|---|---|---|
| BL-7 | Comp | None | 1.32 | 0.48 |
| BL-8 | Comp | D-1 | 1.05 | 0.29 |
| BL-9 | Comp | D-9 | 1.11 | 0.28 |
| BL-10 | Comp | D-8 | 0.85 | 0.47 |
| BL-11 | Invention | AAC-11 | 1.21 | 0.26 |
| BL-12 | Invention | AAC-1 | 1.22 | 0.26 |
| BL-13 | Invention | AAC-4 | 1.10 | 0.27 |
| BL-14 | Invention | AAC-2 | 1.14 | 0.19 |

TABLE 5

Inhibitor Releasing Compounds

| Sample | Comparative or Invention | DIAR Compound | Receiver Gamma | Causer Gamma |
|---|---|---|---|---|
| BL-15 | Comp | None | 1.32 | 0.51 |
| BL-16 | Comp | D-1 | 0.98 | 0.25 |
| BL-17 | Comp | D-8 | 0.76 | 0.37 |
| BL-18 | Invention | AAC-4 | 0.97 | 0.28 |
| BL-19 | Invention | AAC-13 | 0.99 | 0.35 |
| BL-20 | Comp | D-4 | 0.75 | 0.30 |
| BL-21 | Comp | D-3 | 1.02 | 0.25 |
| BL-22 | Invention | AAC-14 | 1.31 | 0.30 |
| BL-23 | Invention | AAC-16 | 1.24 | 0.26 |
| BL-24 | Invention | AAC-17 | 1.31 | 0.38 |
| BL-25 | Invention | AAC-18 | 1.19 | 0.26 |

In these experiments, inhibitor released imagewise in the causer layer should decrease the gamma of the causer layer as well as diffuse into the receiver layer and decrease its gamma as well. The ratio of gamma reduction between the two is a reflection of the combined inherent inhibition strength of the inhibitor fragment, the rate of decomposition of the -switch-INH fragment, its diffusibility and rate of release from the parent coupler upon reaction with Dox. The data in Tables 3, 4 and 5 demonstrate that the inventive compounds, which release the inhibitor via an anthranilic acid switch, effectively reduce receiver gamma. In the cases where the same inhibitor fragment is released (i.e. D-9 and AAC-2 in Table 4 or D-3 and AAC-4 in Table 5), the amount of receiver gamma reduction is similar or greater for the inventive compounds.

Multilayer Film Example

Multilayer films demonstrating the principles of this invention were produced by coating the following layers on a cellulose triacetate film support (coverage are in grams per meter squared, emulsion sizes as determined by the disc centrifuge method and are reported in diameter×thickness in micrometers). Surfactants, coating aids, emulsion addenda (including 4-hydroxy-6-methyl-1,3,3a,7-tetraazaindene), sequestrants, thickeners, lubricants, matte and tinting dyes were added to the appropriate layers as is common in the art. All comparative and inventive compounds were dispersed in twice their own weight in tricresylphosphate.

Sample ML-1:

Layer 1 (Antihalation layer): gelatin at 1.08, colloidal gray silver at 0.150; ILS-1 at 0.097; DYE-1 at 0.008; DYE-2 at 0.061; DYE-3 at 0.025; H-1 at 0.0161 and UV-1 at 0.075.

Layer 2 (Slow cyan layer): a blend of two red-sensitized (both with a mixture of RSD-1, RSD-2 and RSD-3) tabular silver iodobromide emulsions: (i) a 0.7×0.108, 4.5% I at 0.211, (ii) a 0.435×0.112, 0.5% I at 0.334; cyan dye-forming couplers C-1 at 0.332; bleach accelerator releasing coupler B-1 at 0.075; image modifier D-1 at 0.013; image modifier D-2 at 0.021; masking coupler MC-1 at 0.012 and gelatin at 1.811.

Layer 3 (Mid cyan layer): a 1.275×0.122, 3.7% I red-sensitized (with a mixture of RSD-1, RSD-2 and RSD-3) iodobromide tabular emulsion at 0.555; C-1 at 0.167; D-1 at 0.032; D-2 at 0.017; masking coupler MC-1 at 0.072; yellow dye forming coupler Y-1 at 0.070 and gelatin at 1.15.

Layer 4 (Fast cyan layer): a blend of two iodobromide tabular emulsions: (i) a 3.9×0.129, 3.7% I (red-sensitized with a mixture of RSD-1, RSD-3 and RSD-4) at 0.250 and (ii) a 2.3×0.13, 3.7% I (red-sensitized with a mixture of RSD-1, RSD-2 and RSD-3) at 0.525; C-1 at 0.037; D-1 at 0.045; D-2 at 0.050; B-1 at 0.032; MC-1 at 0.030 and gelatin at 0.977.

Layer 5 (Interlayer): D-1 at 0.0161; speed addenda H-1 at 0.025 and gelatin at 0.539.

Layer 6 (Slow magenta layer): a 0.47×0.118, 3% 1 green-sensitized (with a mixture of GSD-1 and GSD-2) silver iodobromide tabular emulsion at 0.300; magenta dye-forming coupler M-1 at 0.182; MC-2 at 0.102 and gelatin at 1.184.

Layer 7 (Mid magenta layer): a blend of three green-sensitized (all with a mixture of GSD-1 and GSD-2) silver iodobromide tabular emulsions: (i) a 1.18×0.121, 4.5% I at 0.485 (ii) a 0.47×0.118, 3% I at 0.120 (iii) a 2.3×0.132, 4.5% I at 0.033; M-1 at 0.296; MC-2 at 0.073; D-3 at 0.029; D-4 at 0.007 and gelatin at 1.705.

Layer 8 (Fast magenta layer): a blend of two green-sensitized (both with a mixture of GSD-1 and GSD-2) silver iodobromide tabular emulsions: a 2.9×0.132, 3.7% I at 0.440 and a 2.3×0.132,4.5% I at 0.560; M-1 at 0.085; MC-2 at 0.082; D-3 at 0.013; D-4 at 0.016; B-1 at 0.0025 and gelatin at 1.276.

Layer 9 (Interlayer): H-1 at 0.025; D-5 at 0.016 and gelatin at 0.538.

Layer 10 (Slow yellow layer): a blend of three blue-sensitized (all with BSD-1 and BSD-2) tabular silver iodobromide emulsions (i) a 1.26×0.137, 4.1% I at 0.160 (ii) a 0.99×0.144, 1.4% I at 0.325 (iii) a 0.53×0.083, 1.3% I at 0.230; Y-1 at 1.060; D-6 at 0.054; D-1 at 0.032; B-1 at 0.005; stabilizer S-1 at 0.024; gelatin at 1.803 and bis (vinylsulfonyl)methane hardener at 1.8% of total gelatin weight added just prior to coating.

Layer 11 (Fast yellow layer): a blend of two blue-sensitized (with BSD-1 and BSD-2) tabular silver iodobromide emulsions: (i) a 2.67×0.13 4.1% I at 0.650 (ii) a 0.53×0.083 1.3% I at 0.230 and a blue sensitized (with BSD-1) 3-D (5 micron diameter), 9.7% I silver iodobromide emulsion at 0.260; silver bromide Lippman emulsion at 0.054; Y-1 at 0.255; Y-2 at 0.108; D-6 at 0.092; B-1 at 0.005 and gelatin at 0.950.

Layer 12 (UV Filter Layer): silver bromide Lippman emulsion at 0.161; UV-1 and UV-2 both at 0.105 and gelatin at 0.690.

Layer 13 (Protective overcoat): gelatin at 0.867.

Sample ML-2: Like ML-1 except D-1 in Layer 4 was removed.

Sample ML-3: Like ML-1 except D-1 in Layer 4 was replaced with D-3 at 0.0633.

Sample ML-4: Like ML-1 except D-1 in Layer 4 was replaced with D-7 at 0.0357.

Sample ML-5: Like ML-1 except D-1 in Layer 4 was replaced with AAC-1 at 0.0489.

Sample ML-6: Like ML-1 except D-1 in Layer 4 was replaced with AAC-4 at 0.0491.

Sample ML-7: Like ML-1 except D-1 in Layer 4 was replaced with AAC-2 at 0.0457.

Sample ML-8: Like ML-1 except ETARC-1 was added to Layer 4 at 0.0708.

Sample ML-9: Like ML-1 except AAC-31 was added to Layer 4 at 0.0695

Formulas for materials used in the above formats are as follows:

ILS-1:

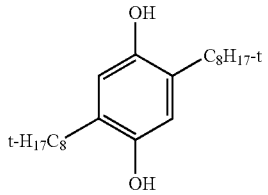

DYE-1:

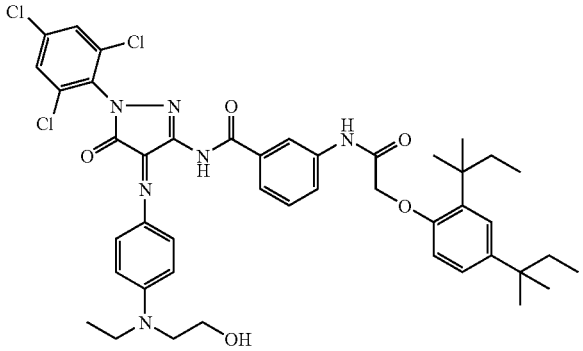

-continued

DYE-2:

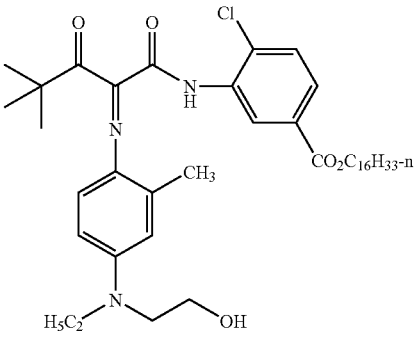

DYE-3:

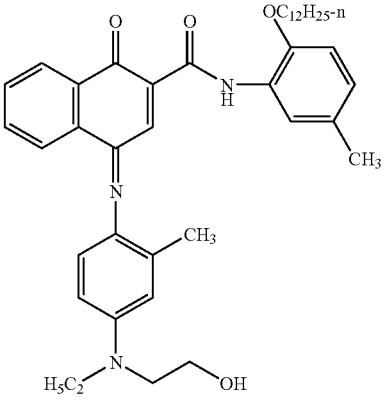

H-1:

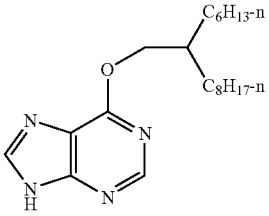

C-1:

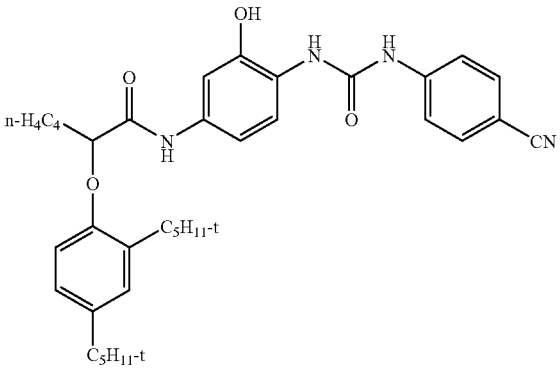

-continued
B-1:
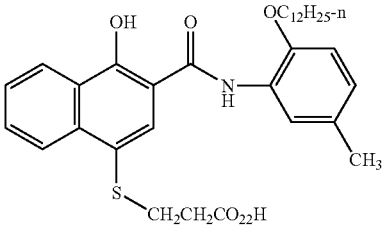
D-1:
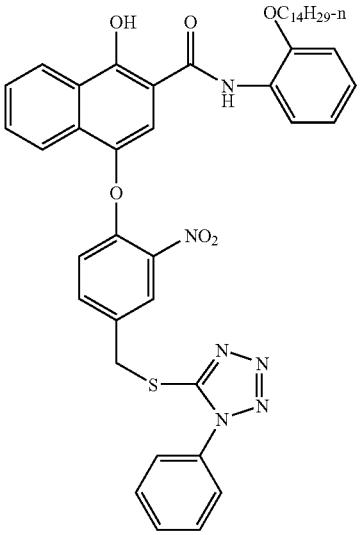
D-2:
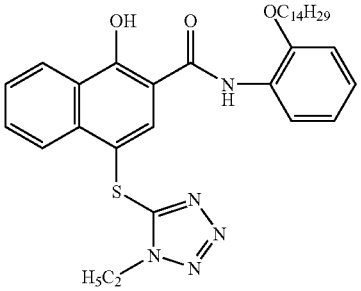
D-3:
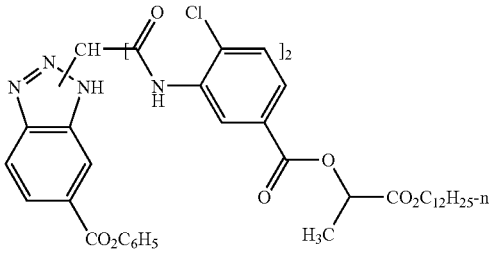
-continued
D-4:
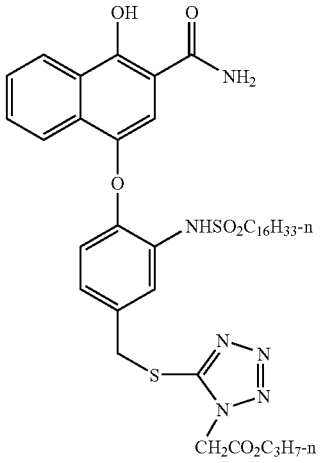
D-5:
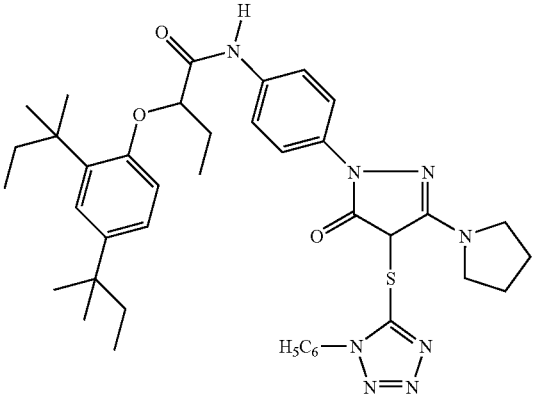
D-6:
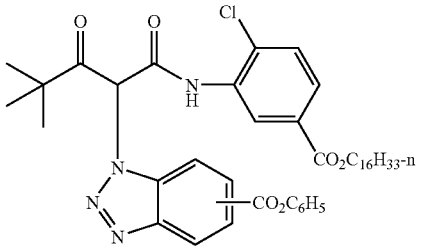
D-7:
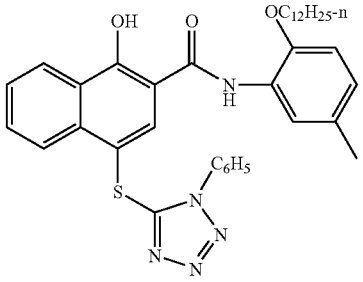

-continued
MC-1:
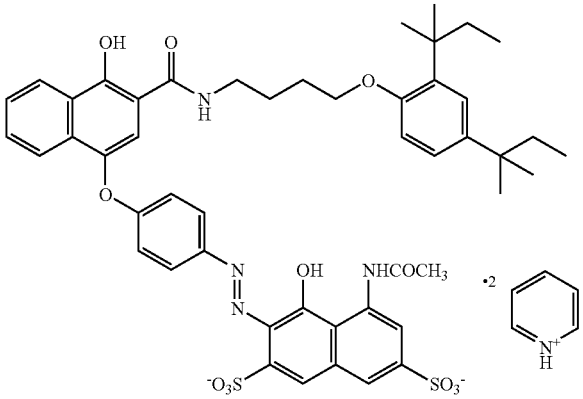
MC-2:
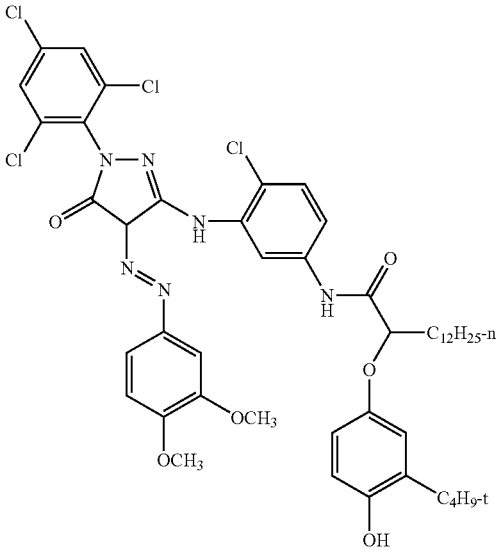
M-1:
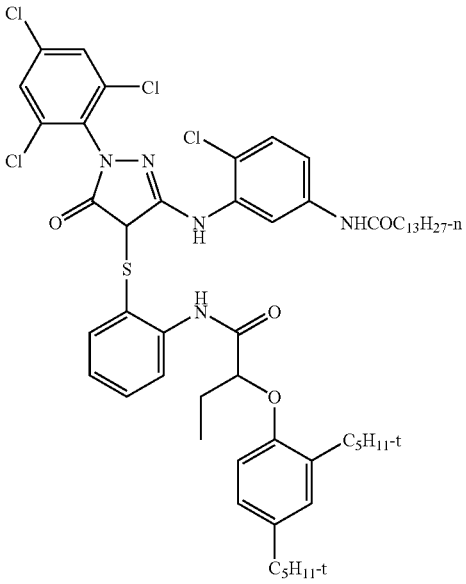
-continued
Y-1:
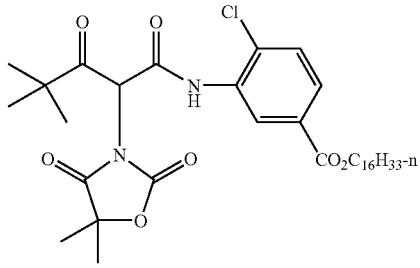
Y-2:
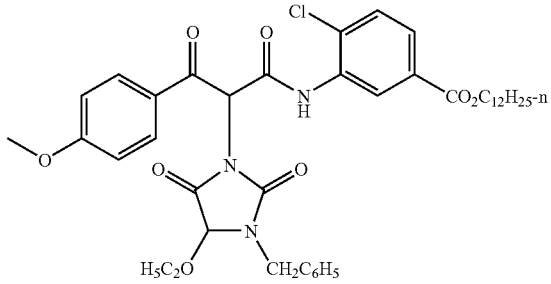
S-1:
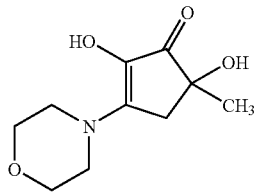
UV-1:
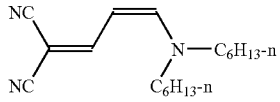
UV-2:
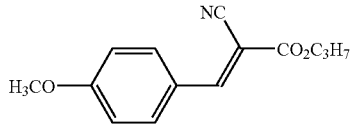
BSD-1:
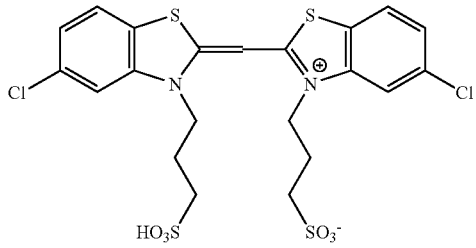

-continued
BSD-2:
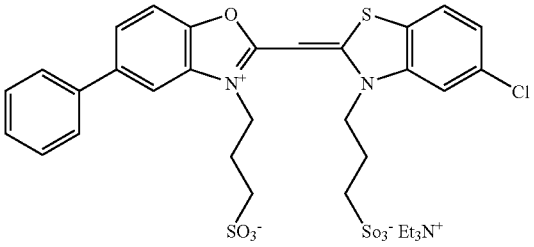
GSD-1:
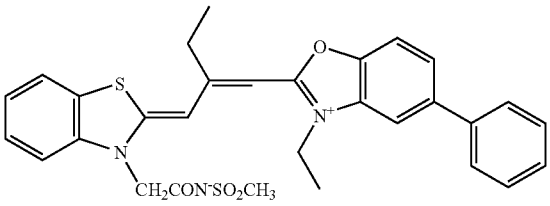
GSD-2:
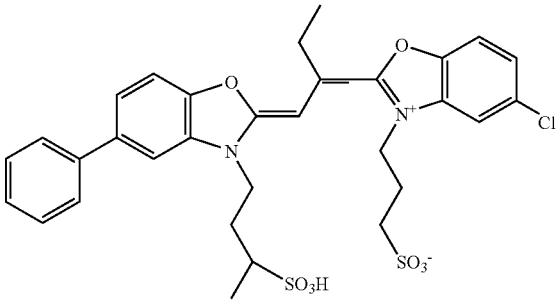
RSD-1:
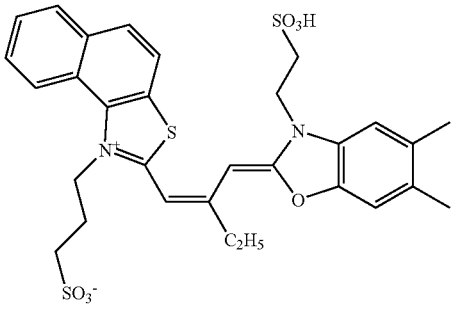
-continued
RSD-2:
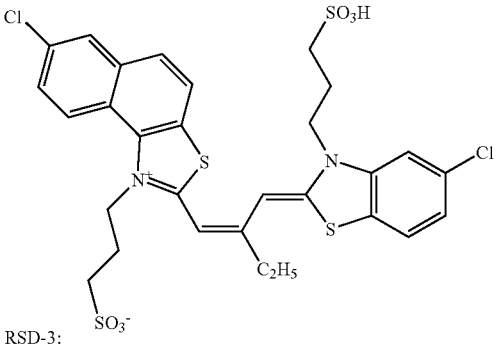
RSD-3:
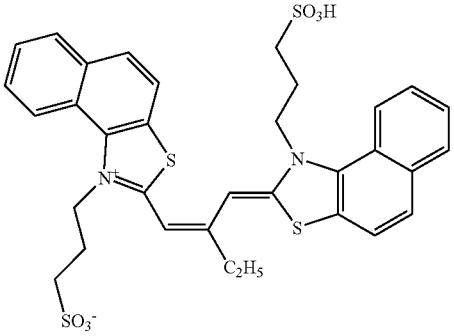
RSD-4:
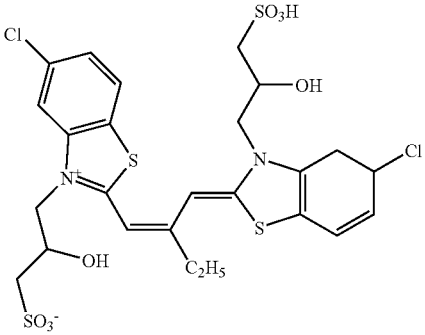
ETARC-1:
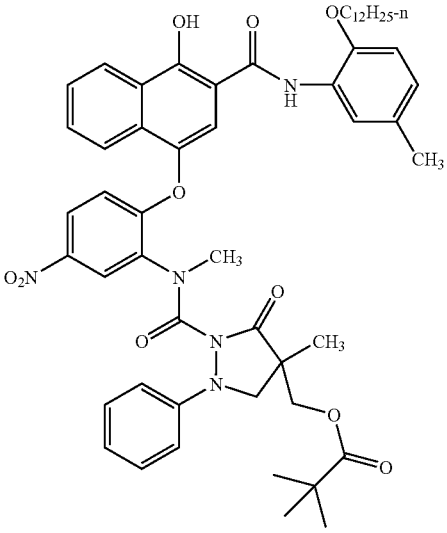

-continued

D-8:

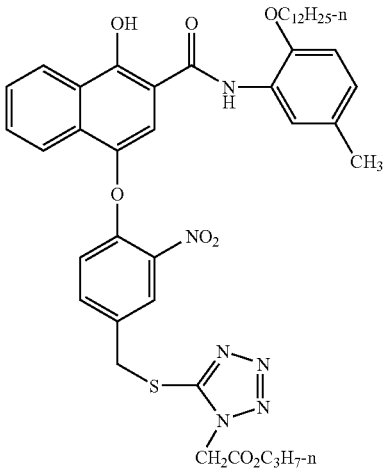

D-9:

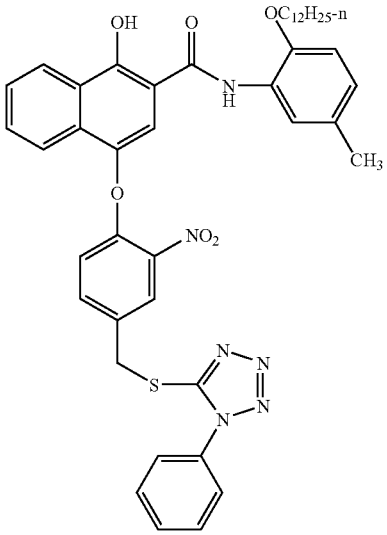

To determine red-onto-green (RG) interimage for the examples that release an inhibitor fragment, the appropriate coatings were given a stepped red record exposure (and processed in the KODAK FLEXICOLOR™ (C-41) process as described in *British Journal of Photography Annual,* 1988, pp 196–198) while the green and blue color layers were simultaneously given a uniform, nonimagewise flash exposure so that the green density ($G_{minR}$) was close to 0.90 when there was no red record development (minimum red exposure point). Then, a red exposure point was determined that was 0.9 logE units more than the point that was 0.15 red density units above red Dmin. The green density ($G_R$) was read at this red exposure point. RG interimage is the difference in green density $G_R$-$G_{minR}$ and represents the decrease in green layer development as a function of red development. In this case, a negative number reflects a greater loss in density and hence, an increase in red-onto-green interimage. To measure the red acutance (a measure of sharpness), the modulation transfer function (MTF) was determined. Discussions concerning the measurement of MTF can be found in "The Reproduction of Colour", 4$^{th}$ Edition, R. W. G Hunt, Fountain Press, UK, 1988, pp 356–365; "Optical Radiation Measurements", Volume 5, C. J. Bartleson and F. Grum, Academic Press, Orlando, Fla., pp 298–304; "The Theory of The Photographic Process", 4$^{th}$ Edition, T. H. James, Macmillan Publishing, NY, pp 617–618. The MTF values were cascaded (as described in the above references) to give "DMT" values that are predictors of sharpness of the film as a standard 35 mm print at 4R magnification. Higher DMT values imply increased sharpness. Results are shown in Table 6.

TABLE 6

Inhibitor Releasing Compounds

| Sample | Comparative or Invention | Compound in Layer 4 | RG Interimage | Red Acutance (DMT) |
|---|---|---|---|---|
| ML-1 | Comp | D-1 | −0.153 | 38.0 |
| ML-2 | Comp | None | −0.118 | 37.7 |
| ML-3 | Comp | D-3 | −0.189 | 37.8 |
| ML-4 | Comp | D-7 | −0.136 | 37.3 |
| ML-5 | Inv | AAC-1 | −0.179 | 37.5 |
| ML-6 | Inv | AAC-4 | −0.192 | 37.8 |
| ML-7 | Inv | AAC-2 | −0.244 | 37.6 |

The data in Table 6 clearly show that the inventive compounds give high red-onto-green interimage relative to compounds that release the same inhibitor fragment directly. For example, AAC-4 gives a RG interimage value of −0.192 whereas D-3 has a value of −0.189. Likewise, AAC-2 has a RG interimage value of −0.244 compared to D-7 which is only −0.136. Likewise, acutance is the same or higher with the inventive compounds compared to compounds that release the same fragment directly.

The multilayer coatings that contain the examples that release an ETA fragment were given a neutral stepped exposure and processed in the KODAK FLEXICOLOR™ (C-41) process as described above. The processed images were read with red light to determine the gamma (the maximum slope between any two density points) and relative speed (the exposure point +0.15 units above Dmin divided by the same point for ML-1). Results are shown in Table 7.

TABLE 7

ETA Releasing Compounds

| Sample | Comparative or Invention | ETA Compound in Layer 4 | Gamma | Relative Speed |
|---|---|---|---|---|
| ML-1 | Comp | None | 0.66 | 1.000 |
| ML-8 | Comp | ETARC-1 | 0.91 | 1.016 |
| ML-9 | Inv | AAC-31 | 0.82 | 1.016 |

As the results in Table 7 demonstrate, a compound with the timing group of the invention can release an ETA fragment to give the desired gamma and speed increases. In this example, materials like AAC-31 are much easier to prepare than the compounds with the carbamate timing group used in ETARC-1.

The invention has been described in detail with particular reference to certain preferred embodiments thereof, but it will be understood that variations and modifications can be effected within the spirit and scope of the invention.

What is claimed is:

1. A silver halide photographic element comprising a support, at least one light-sensitive silver halide emulsion layer, and an anthranilic acid compound according to Formula (II):

$$G\text{-}(TG1)_q\text{-}(AATG)\text{-}(TG2)_p\text{-}PUG$$

where G is a group in which the bond to the timing group is cleaved upon reaction with oxidized developer; TG1 and TG2 represent any known timing or switching group and may be the same or different; q and p are independently 0 or 1; AATG represents an anthranilic acid timing group and PUG is a photographically useful group.

2. The photographic element of claim 1 wherein G is a moiety that reacts with oxidized developer by a coupling reaction to form a stable or unstable dye.

3. The photographic element of claim 1 wherein q and p are both 0.

4. The photographic element of claim 1 wherein the PUG is either an inhibitor of silver development or an electron transfer agent.

5. The photographic element of claim 1 wherein the anthranilic acid compound is according to either Formula (IIa) or (IIb):

Formula (IIa)

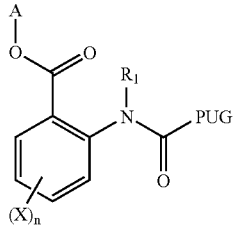

Formula (IIb)

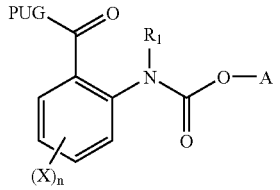

wherein:

A is a group in which the bond to oxygen is cleaved upon reaction with oxidized developer;

X is an optional substituent;

N is 0 to 4;

R1 is an alkyl, aryl or heterocychic group with the provisio that R1 may be connected with X or the phenyl ring to form an additional ring system; and PUG is a photographically useful group.

6. The photographic element of claim 5 wherein A is a moiety that reacts with oxidized developer by a coupling reaction to form a stable or unstable dye.

7. The photographic element of claim 6 wherein n is zero and $R_1$ is an alkyl group.

8. The photographic element of claim 5 wherein the PUG is an inhibitor of silver development.

9. The photographic element of claim 8 where the inhibitor is a benzotriazole.

10. The photographic element of claim 5 where the PUG is an electron transfer agent.

11. The photographic element of claim 10 wherein the electron transfer agent is a 1-aryl-3-pyrazolidinone.

12. The photographic element of claim 7 wherein A is a napthol coupler.

13. The photographic element of claim 7 wherein A is an acetoanilide coupler.

14. The photographic element of claim 5 wherein the anthranilic acid compound is according to Formula (IIa).

15. The photographic element of claim 14 wherein A is a moiety that reacts with oxidized developer by a coupling reaction to form a stable or unstable dye.

16. The photographic element of claim 15 wherein n is zero and $R_1$ is an alkyl group.

17. The photographic element of claim 14 wherein the PUG is an inhibitor of silver development or an electron transfer agent.

18. The photographic element of claim 17 wherein PUG is an inhibitor of silver and the inhibitor is a benzotriazole.

19. The photographic element of claim 17 wherein PUG is an electron transfer agent and the electron transfer agent is a 1-aryl-3-pyrazolidinone.

20. The photographic element of claim 16 wherein A is a napthol coupler.

21. The photographic element of claim 16 wherein A is an acetoanilide coupler.

* * * * *